US012442161B2

(12) United States Patent
Meguriya et al.

(10) Patent No.: US 12,442,161 B2
(45) Date of Patent: Oct. 14, 2025

(54) WORK MACHINE

(71) Applicant: HITACHI CONSTRUCTION MACHINERY CO., LTD., Tokyo (JP)

(72) Inventors: Shuuichi Meguriya, Ishioka (JP); Teruki Igarashi, Tsuchiura (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 222 days.

(21) Appl. No.: 18/032,285

(22) PCT Filed: Oct. 14, 2021

(86) PCT No.: PCT/JP2021/038037
§ 371 (c)(1),
(2) Date: Apr. 17, 2023

(87) PCT Pub. No.: WO2022/085556
PCT Pub. Date: Apr. 28, 2022

(65) Prior Publication Data

US 2024/0026656 A1 Jan. 25, 2024

(30) Foreign Application Priority Data

Oct. 19, 2020 (JP) ..... 2020-175560

(51) Int. Cl.
*E02F 9/26* (2006.01)
*E02F 3/43* (2006.01)
*E02F 9/22* (2006.01)

(52) U.S. Cl.
CPC ..... *E02F 9/262* (2013.01); *E02F 3/439* (2013.01); *E02F 9/2228* (2013.01);
(Continued)

(58) Field of Classification Search
CPC ..... E02F 9/262; E02F 3/439; E02F 9/2228; E02F 9/2285; E02F 9/2292; E02F 9/2296
See application file for complete search history.

(56) References Cited

U.S. PATENT DOCUMENTS

2014/0326039 A1* 11/2014 Ikegami ..... F15B 15/2815 73/1.79
2016/0273186 A1* 9/2016 Kami ..... E02F 9/2296
(Continued)

FOREIGN PATENT DOCUMENTS

CN 109757113 A 5/2019
JP 2018-003386 A 1/2018
(Continued)

OTHER PUBLICATIONS

International Search Report of PCT/JP2021/038037 dated Dec. 7, 2021.
(Continued)

*Primary Examiner* — Dale W Hilgendorf
*Assistant Examiner* — Hana Lee
(74) *Attorney, Agent, or Firm* — Mattingly & Malur, PC

(57) ABSTRACT

A work machine includes a swing structure, a work device, a position sensor, a posture sensor and a controller that performs machine control on the basis of a target surface set on the basis of target shape data, the position information of the swing structure, and the information about the posture of the work machine. When the controller becomes unable to obtain the position information of the swing structure, the controller stores swing angle information of the swing structure, the swing angle information being sensed by the posture sensor at that time. The controller prohibits execution of the machine control when the swing structure is positioned outside a swing range; and permits the execution of the machine control when the swing structure is positioned inside the swing range and when the swing structure
(Continued)

is positioned inside the swing range again after being positioned outside the swing range.

6 Claims, 14 Drawing Sheets

(52) U.S. Cl.
CPC ..... *E02F 9/2285* (2013.01); *E02F 9/2292* (2013.01); *E02F 9/2296* (2013.01)

(56) References Cited

U.S. PATENT DOCUMENTS

| | | | | |
|---|---|---|---|---|
| 2017/0028922 | A1* | 2/2017 | Matsuo | B60R 1/002 |
| 2020/0217050 | A1 | 7/2020 | Chiba et al. | |
| 2021/0047808 | A1 | 2/2021 | Yamada et al. | |
| 2022/0074168 | A1* | 3/2022 | Yamada | E02F 9/123 |
| 2023/0383497 | A1* | 11/2023 | Graham | E02F 3/7613 |

FOREIGN PATENT DOCUMENTS

| | | | |
|---|---|---|---|
| JP | 2020-002625 | A | 1/2020 |
| WO | 2015/181990 | A1 | 12/2015 |

OTHER PUBLICATIONS

International Preliminary Report on Patentability received in corresponding International Application No. PCT/JP2021/038037 dated Apr. 20, 2023.
Chinese Office Action received in corresponding Chinese Application No. 202180070954.8 dated Apr. 3, 2025.

* cited by examiner

WORK MACHINE

TECHNICAL FIELD

The present invention relates to a work machine.

BACKGROUND ART

A control system that controls a work machine provided with a work device having a work tool is known (see Patent Document 1). The control system described in Patent Document 1 obtains the position of the work device on the basis of position information sensed by a position sensor and generates target excavation terrain profile information from information about a target construction surface representing a target shape, and performs excavation control that controls the velocity of the work device in a direction of approaching an excavation target to a limit velocity or lower on the basis of the target excavation terrain profile information. When the control system is unable to obtain the target excavation terrain profile information during the execution of the excavation control, the control system continues the excavation control by using the target excavation terrain profile information before a point in time that the control system became unable to obtain the target excavation terrain profile information.

In addition, the control system described in Patent Document 1 retains the target excavation terrain profile information before the point in time that the control system became unable to obtain the target excavation terrain profile information for a fixed time determined in advance, ends the retention of the target excavation terrain profile information on the basis of a travelling of the work machine or a swing of a swing structure to which the work device is attached after the passage of the fixed time, and ends the excavation control being performed.

PRIOR ART DOCUMENT

Patent Document

Patent Document 1: PCT Patent Publication No. WO2015/181990

SUMMARY OF THE INVENTION

Problem to be Solved by the Invention

The control system described in Patent Document 1 ends the retention of the target excavation terrain profile information when the swing structure is swung at a time of loading an excavated object onto a transportation vehicle such as a dump truck, for example. Thus, thereafter, the excavation control cannot be performed until the target excavation terrain profile information can be obtained. Work efficiency is consequently decreased.

It is an object of the present invention to provide a work machine that can suppress a decrease in work efficiency.

Means for Solving the Problem

A work machine according to one aspect of the present invention includes: a track structure; a swing structure swingably attached onto the track structure; a work device attached to the swing structure; a position sensor that senses position information of the swing structure; a posture sensor that senses information about a posture of the work machine, the information including a swing angle of the swing structure; and a controller configured to obtain target shape data, set a target surface on a basis of the obtained target shape data, the position information of the swing structure, and the information about the posture of the work machine, and perform machine control that controls the work device on a basis of the target surface. The controller is configured to, when the controller becomes unable to obtain the position information of the swing structure by the position sensor, store, as reference swing angle information, swing angle information when the controller becomes unable to obtain the position information of the swing structure by the position sensor. The controller is configured to prohibit execution of the machine control based on the target surface, when the swing structure is positioned outside a swing range set on a basis of the reference swing angle information. The controller is configured to permit the execution of the machine control based on the target surface, when the swing structure is positioned inside the swing range and when the swing structure is positioned inside the swing range again after being positioned outside the swing range.

Advantages of the Invention

According to the present invention, it is possible to provide a work machine that can suppress a decrease in work efficiency.

MODES FOR CARRYING OUT THE INVENTION

Figure 1:
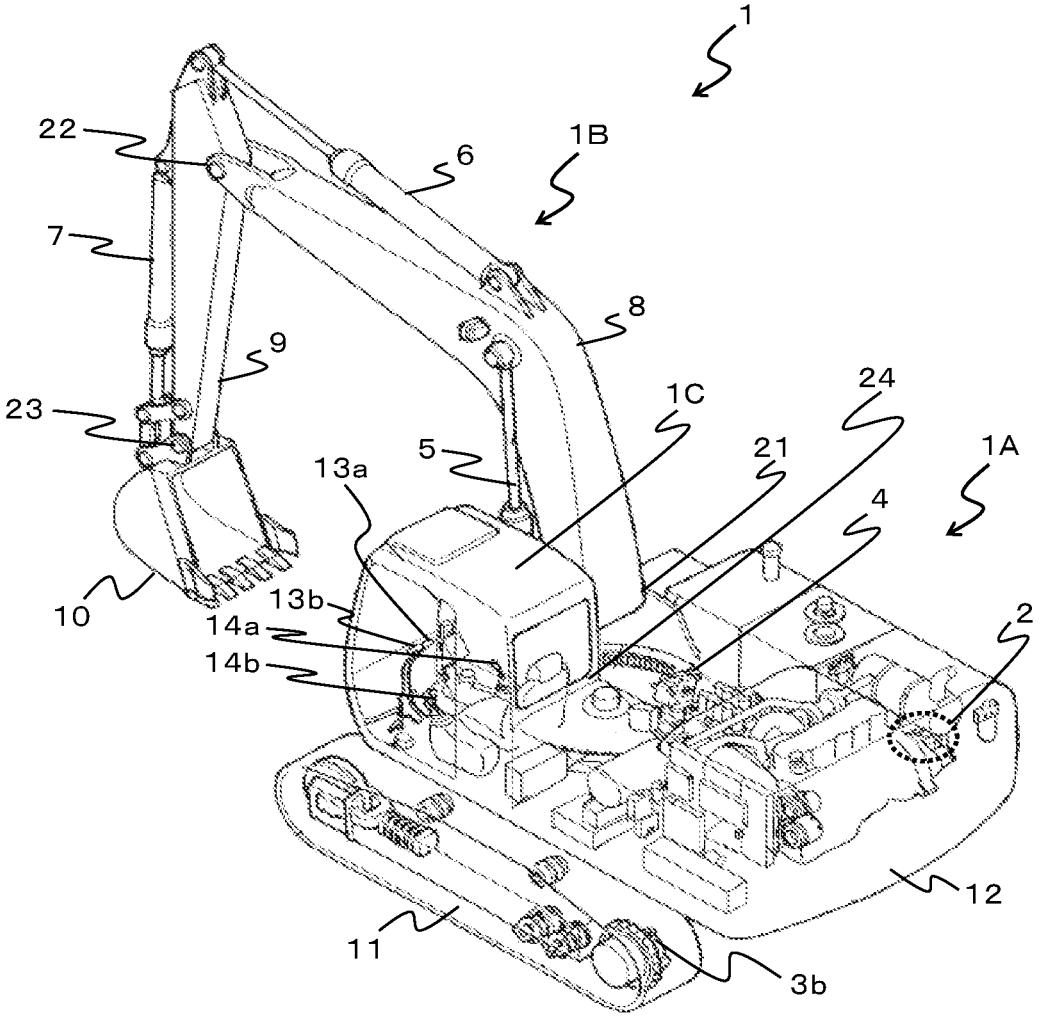
FIG. 1 is a perspective view of a hydraulic excavator according to an embodiment of the present invention.

Referring to the drawings, description will hereinafter be made by taking a hydraulic excavator as an example of a work machine according to an embodiment of the present invention. Incidentally, in the figures, equivalent members are identified by the same reference numerals, and repeated description thereof will be omitted as appropriate.

FIG. 1 is a perspective view of a hydraulic excavator 1 according to the present embodiment. As shown in FIG. 1, the hydraulic excavator (work machine) 1 includes a machine body 1A and an articulated front work device (hereinafter simply written as a work device) 1B attached to the machine body 1A. The machine body 1A includes a track structure 11 and a swing structure 12 swingably attached onto the track structure 11. The track structure 11 is driven for travelling by a travelling right motor (not shown) and a travelling left motor 3*b*. The swing structure 12 is driven for swinging by a swing hydraulic motor 4.

The work device 1B includes a plurality of driven members (8, 9, and 10) rotatably coupled to each other and a plurality of hydraulic cylinders (5, 6, and 7) that drive the driven members. The work device 1B is attached to the swing structure 12. In the present embodiment, a boom 8, an arm 9, and a bucket 10 as three driven members are serially coupled to each other. A proximal end portion of the boom 8 is rotatably coupled at a front portion of the swing structure 12 by a boom pin 91 (see FIG. 5). A proximal end portion of the arm 9 is rotatably coupled at a distal end portion of the boom 8 by an arm pin 92 (see FIG. 5). The bucket 10 as a work tool is rotatably coupled at a distal end portion of the arm 9 by a bucket pin 93 (see FIG. 5). The boom pin 91, the arm pin 92, and the bucket pin 93 are arranged in parallel with each other, and the respective driven members (8, 9, and 10) are relatively rotatable within a same plane.

The boom 8 is rotated by expanding and contracting operations of a boom cylinder 5. The arm 9 is rotated by expanding and contracting operations of an arm cylinder 6. The bucket 10 is rotated by expanding and contracting operations of a bucket cylinder 7. The boom cylinder 5 has one end side thereof connected to the boom 8, and has another end side thereof connected to a frame of the swing structure 12. The arm cylinder 6 has one end side thereof connected to the arm 9, and has another end side thereof connected to the boom 8. The bucket cylinder 7 has one end side thereof connected to the bucket 10 via a bucket link (link member), and has another end side thereof connected to the arm 9.

A cab 1C to be boarded by an operator is provided on a left side of a front portion of the swing structure 12. Arranged in the cab 1C are a travelling right lever 13*a* and a travelling left lever 13*b* for giving operation instructions to the track structure 11 as well as an operation right lever 14*a* and an operation left lever 14*b* for giving operation instructions to the boom 8, the arm 9, the bucket 10, and the swing structure 12.

An angle sensor 21 that senses the rotational angle of the boom 8 (boom angle $\alpha$) is attached to the boom pin 91 that couples the boom 8 to the swing structure 12. An angle sensor 22 that senses the rotational angle of the arm 9 (arm angle M is attached to the arm pin 92 that couples the arm 9 to the boom 8. An angle sensor 23 that senses the rotational angle of the bucket 10 (bucket angle $\gamma$) is attached to the bucket pin 93 that couples the bucket 10 to the arm 9. Attached to the swing structure 12 is an angle sensor 24 that senses the inclination angle (pitch angle $\varphi$) in a forward-rearward direction of the swing structure 12 (machine body 1A) with respect to a reference plane (for example, a horizontal plane) and the inclination angle (roll angle $\psi$) in a left-right direction of the swing structure 12 (machine body 1A) with respect to the reference plane as well as the relative angle (swing angle $\theta$) of the swing structure 12 with respect to the track structure 11 in a plane orthogonal to a swing central axis. Angle signals output from the angle sensors 21 to 24 are input to a controller 20 (see FIG. 2) to be described later.

Figure 2:
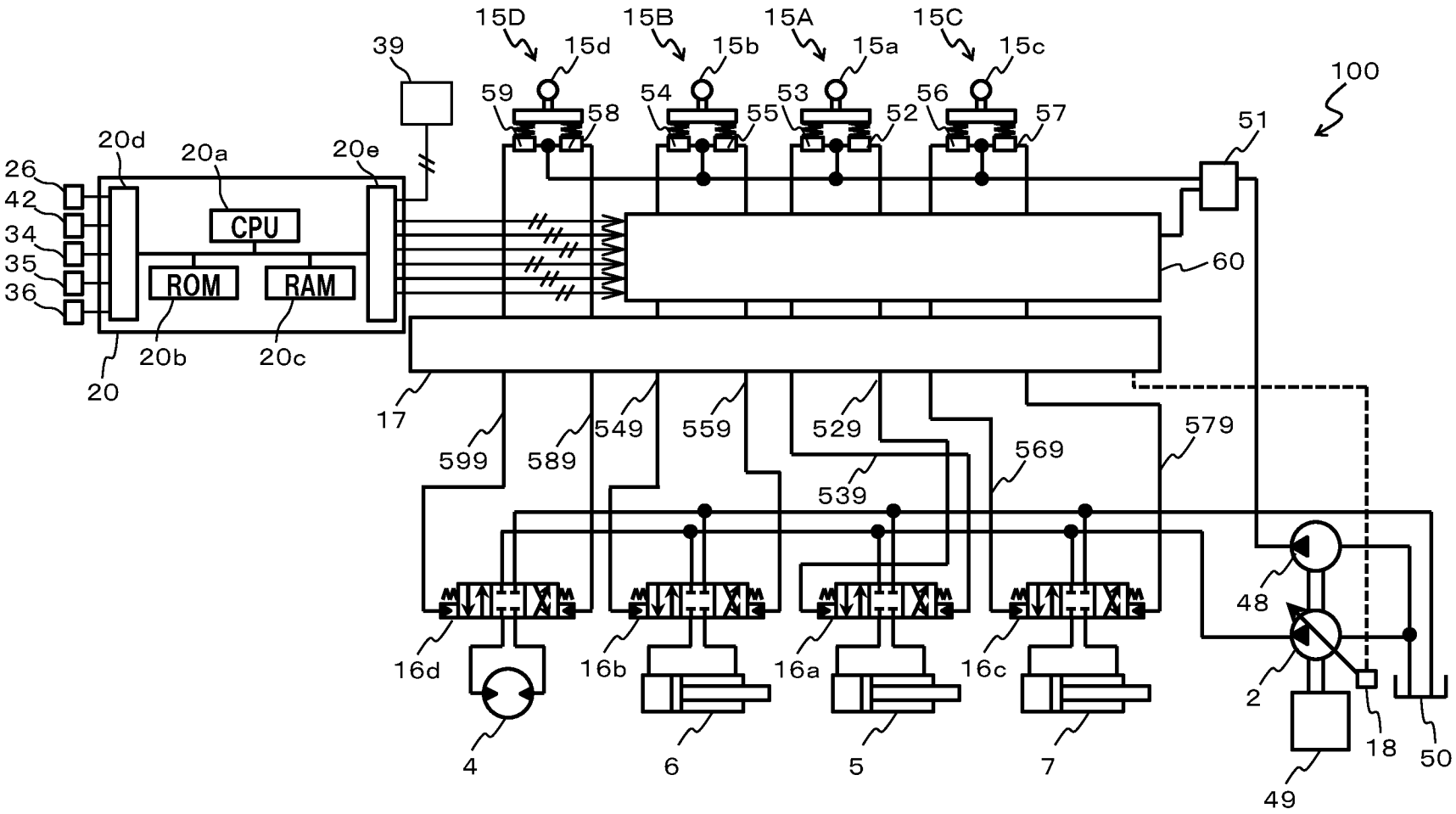
FIG. 2 is a schematic configuration diagram of a hydraulic drive system included in the hydraulic excavator.

FIG. 2 is a schematic configuration diagram of a hydraulic drive system 100 included in the hydraulic excavator 1 shown in FIG. 1. Incidentally, for simplification of the description, FIG. 2 shows only parts related to the driving of the boom cylinder 5, the arm cylinder 6, the bucket cylinder 7, and the swing hydraulic motor 4, and omits parts related to the driving of other hydraulic actuators.

As shown in FIG. 2, the hydraulic drive system 100 includes: hydraulic actuators (4 to 7); a prime mover 49; a hydraulic pump 2 and a pilot pump 48 driven by the prime mover 49; flow control valves 16*a* to 16*d* that control directions and flow rates of hydraulic operating fluid (working fluid) supplied from the hydraulic pump 2 to the hydraulic actuators 4 to 7; operation devices 15A to 15D of a hydraulic pilot type for operating the flow control valves 16*a* to 16*d*; a hydraulic control unit 60; a shuttle block 17; and a controller 20 that controls various parts of the hydraulic excavator 1.

The prime mover 49 is a power source of the hydraulic excavator 1. The prime mover 49 is, for example, constituted by an internal combustion engine such as a diesel engine. The hydraulic pump 2 includes a tilting swash plate mechanism (not shown) having a pair of input and output ports and a regulator 18 that adjusts a delivery capacity (displacement volume) by adjusting the tilting angle of a swash plate. The regulator 18 is operated by a pilot pressure supplied from the shuttle block 17 to be described later.

The pilot pump 48 is connected to pilot pressure control valves 52 to 59 and the hydraulic control unit 60 to be described later via a lock valve 51. The lock valve 51 is opened and closed according to operation of a gate lock lever (not shown) provided in the vicinity of an entrance to the cab 1C. When the gate lock lever is operated to a lowered position (lock release position) that limits the entrance to the cab 1C, the lock valve 51 is opened by a command from the controller 20. Consequently, the delivery pressure of the pilot pump 48 (which pressure will hereinafter be referred to as a pilot primary pressure) is supplied to the pilot pressure control valves 52 to 59 and the hydraulic control unit 60, and thereby allows operation of the flow control valves 16*a* to 16*d* by the operation devices 15A to 15D. When the gate lock lever is operated to a raised position (lock position) that opens the entrance to the cab 1C, on the other hand, the lock valve 51 is closed by a command from the controller 20. Consequently, the supply of the pilot primary pressure from the pilot pump 48 to the pilot pressure control valves 52 to 59 and the hydraulic control unit 60 is stopped, and thereby the operation of the flow control valves 16*a* to 16*d* by the operation devices 15A to 15D is disabled.

The operation device 15A is an operation device for operating the boom 8 (boom cylinder 5). The operation device 15A includes a boom control lever 15*a*, a boom raising pilot pressure control valve 52, and a boom lowering pilot pressure control valve 53. Here, the boom control lever 15*a*, for example, corresponds to the operation right lever 14*a* (see FIG. 1) when operated in the forward-rearward direction.

The boom raising pilot pressure control valve 52 reduces the pilot primary pressure supplied thereto via the lock valve 51, and thereby generates a pilot pressure corresponding to a lever stroke (hereinafter an operation amount) in a boom raising direction of the boom control lever 15*a* (which pilot pressure will hereinafter be referred to as a boom raising pilot pressure). The boom raising pilot pressure output from the boom raising pilot pressure control valve 52 is introduced into one pilot pressure receiving portion (on the left side in the figure) of the boom flow control valve 16*a* via the hydraulic control unit 60, the shuttle block 17, and a pilot line 529, and drives the boom flow control valve 16*a* in a right direction in the figure. Consequently, the hydraulic operating fluid delivered from the hydraulic pump 2 is supplied to the bottom side of the boom cylinder 5, and the hydraulic operating fluid on the rod side of the boom cylinder 5 is discharged into a tank 50, so that the boom cylinder 5 is expanded.

The boom lowering pilot pressure control valve 53 reduces the pilot primary pressure supplied thereto via the lock valve 51, and thereby generates a pilot pressure corresponding to an operation amount in a boom lowering direction of the boom control lever 15*a* (which pilot pressure will hereinafter be referred to as a boom lowering pilot pressure). The boom lowering pilot pressure output from the boom lowering pilot pressure control valve 53 is introduced into another pilot pressure receiving portion (on the right side in the figure) of the boom flow control valve 16*a* via the hydraulic control unit 60, the shuttle block 17, and a pilot line 539, and drives the boom flow control valve 16*a* in the left direction in the figure. Consequently, the hydraulic operating fluid delivered from the hydraulic pump 2 is supplied to the rod side of the boom cylinder 5, and the hydraulic operating fluid on the bottom side of the boom cylinder 5 is discharged into the tank 50, so that the boom cylinder 5 is contracted.

The operation device 15B is an operation device for operating the arm 9 (arm cylinder 6). The operation device 15B includes an arm control lever 15*b*, an arm crowding pilot pressure control valve 54, and an arm dumping pilot pressure control valve 55. Here, the arm control lever 15*b*, for example, corresponds to the operation left lever 14*b* (see FIG. 1) when operated in the left-right direction.

The arm crowding pilot pressure control valve 54 reduces the pilot primary pressure supplied thereto via the lock valve 51, and thereby generates a pilot pressure corresponding to an operation amount in an arm crowding direction of the arm control lever 15*b* (which pilot pressure will hereinafter be referred to as an arm crowding pilot pressure). The arm crowding pilot pressure output from the arm crowding pilot pressure control valve 54 is introduced into one pilot pressure receiving portion (on the left side in the figure) of the arm flow control valve 16*b* via the hydraulic control unit 60, the shuttle block 17, and a pilot line 549, and drives the arm flow control valve 16*b* in the right direction in the figure. Consequently, the hydraulic operating fluid delivered from the hydraulic pump 2 is supplied to the bottom side of the arm cylinder 6, and the hydraulic operating fluid on the rod side of the arm cylinder 6 is discharged into the tank 50, so that the arm cylinder 6 is expanded.

The arm dumping pilot pressure control valve 55 reduces the pilot primary pressure supplied thereto via the lock valve 51, and thereby generates a pilot pressure corresponding to an operation amount in an arm dumping direction of the arm control lever 15*b* (which pilot pressure will hereinafter be referred to as an arm dumping pilot pressure). The arm dumping pilot pressure output from the arm dumping pilot pressure control valve 55 is introduced into another pilot pressure receiving portion (on the right side in the figure) of the arm flow control valve 16*b* via the hydraulic control unit 60, the shuttle block 17, and a pilot line 559, and drives the arm flow control valve 16*b* in the left direction in the figure. Consequently, the hydraulic operating fluid delivered from the hydraulic pump 2 is supplied to the rod side of the arm cylinder 6, and the hydraulic operating fluid on the bottom side of the arm cylinder 6 is discharged into the tank 50, so that the arm cylinder 6 is contracted.

The operation device 15C is an operation device for operating the bucket 10 (bucket cylinder 7). The operation device 15C includes a bucket control lever 15*c*, a bucket crowding pilot pressure control valve 56, and a bucket dumping pilot pressure control valve 57. Here, the bucket control lever 15*c*, for example, corresponds to the operation right lever 14*a* (see FIG. 1) when operated in the left-right direction.

The bucket crowding pilot pressure control valve 56 reduces the pilot primary pressure supplied thereto via the lock valve 51, and thereby generates a pilot pressure corresponding to an operation amount in a bucket crowding direction of the bucket control lever 15*c* (which pilot pressure will hereinafter be referred to as a bucket crowding pilot pressure). The bucket crowding pilot pressure output from the bucket crowding pilot pressure control valve 56 is introduced into one pilot pressure receiving portion (on the left side in the figure) of the bucket flow control valve 16*c* via the hydraulic control unit the shuttle block 17, and a pilot line 569, and drives the bucket flow control valve 16*c* in the right direction in the figure. Consequently, the hydraulic operating fluid delivered from the hydraulic pump 2 is supplied to the bottom side of the bucket cylinder 7, and the hydraulic operating fluid on the rod side of the bucket cylinder 7 is discharged into the tank 50, so that the bucket cylinder 7 is expanded.

The bucket dumping pilot pressure control valve 57 reduces the pilot primary pressure supplied thereto via the lock valve 51, and thereby generates a pilot pressure corresponding to an operation amount in a bucket dumping direction of the bucket control lever 15*c* (which pilot pressure will hereinafter be referred to as a bucket dumping pilot pressure). The bucket dumping pilot pressure output from the bucket dumping pilot pressure control valve 57 is introduced into another pilot pressure receiving portion (on the right side in the figure) of the bucket flow control valve 16*c* via the hydraulic control unit 60, the shuttle block 17, and a pilot line 579, and drives the bucket flow control valve 16*c* in the left direction in the figure. Consequently, the hydraulic operating fluid delivered from the hydraulic pump 2 is supplied to the rod side of the bucket cylinder 7, and the hydraulic operating fluid on the bottom side of the bucket cylinder 7 is discharged into the tank 50, so that the bucket cylinder 7 is contracted.

The operation device 15D includes a swing control lever 15*d*, a right swing pilot pressure control valve 58, and a left swing pilot pressure control valve 59. Here, the swing control lever 15*d*, for example, corresponds to the operation left lever 14*b* (see FIG. 1) when operated in the forward-rearward direction.

The right swing pilot pressure control valve 58 reduces the pilot primary pressure supplied thereto via the lock valve 51, and thereby generates a pilot pressure corresponding to an operation amount in a right swing direction of the swing control lever 15*d* (which pilot pressure will hereinafter be referred to as a right swing pilot pressure). The right swing pilot pressure output from the right swing pilot pressure control valve 58 is introduced into one pilot pressure receiving portion (on the right side in the figure) of the swing flow control valve 16*d* via the shuttle block 17 and a pilot line 589, and drives the swing flow control valve 16*d* in the left direction in the figure. Consequently, the hydraulic operating fluid delivered from the hydraulic pump 2 flows into one inlet/outlet port (on the right side in the figure) of the swing hydraulic motor 4, and the hydraulic operating fluid flowing out from another inlet/outlet port (on the left side in the figure) of the swing hydraulic motor 4 is discharged into the tank 50, so that the swing hydraulic motor 4 rotates in one direction (direction of swinging the swing structure 12 to the right).

The left swing pilot pressure control valve 59 reduces the pilot primary pressure supplied thereto via the lock valve 51, and thereby generates a pilot pressure corresponding to an operation amount in a left swing direction of the swing control lever 15*d* (which pilot pressure will hereinafter be referred to as a left swing pilot pressure). The left swing pilot pressure output from the left swing pilot pressure control valve 59 is introduced into another pilot pressure receiving portion (on the left side in the figure) of the swing flow control valve 16*d* via the shuttle block 17 and a pilot line 599, and drives the swing flow control valve 16*d* in the right direction in the figure. Consequently, the hydraulic operating fluid delivered from the hydraulic pump 2 flows into the other inlet/outlet port (on the left side in the figure) of the swing hydraulic motor 4, and the hydraulic operating fluid discharged from the one inlet/outlet port (on the right side in the figure) of the swing hydraulic motor 4 is discharged into the tank 50, so that the swing hydraulic motor 4 rotates in another direction (direction of swinging the swing structure 12 to the left).

The hydraulic control unit 60 is an apparatus for performing machine control (MC). The hydraulic control unit 60 corrects the pilot pressures input from the pilot pressure control valves 52 to 57 according to commands from the controller 20, and outputs the resulting pilot pressures to the shuttle block 17. Consequently, the work device 1B can be made to perform a desired operation irrespective of the lever operation of the operator.

The shuttle block 17 outputs, to the pilot lines 529, 539, 549, 559, 569, and 579, the pilot pressures input from the hydraulic control unit 60. In addition, the shuttle block 17 selects a maximum pilot pressure among the input pilot pressures, and outputs the maximum pilot pressure to the regulator 18 of the hydraulic pump 2. Consequently, the delivery flow rate of the hydraulic pump 2 can be controlled according to the operation amounts of the control levers 15*a* to 15*d*.

Figure 3:
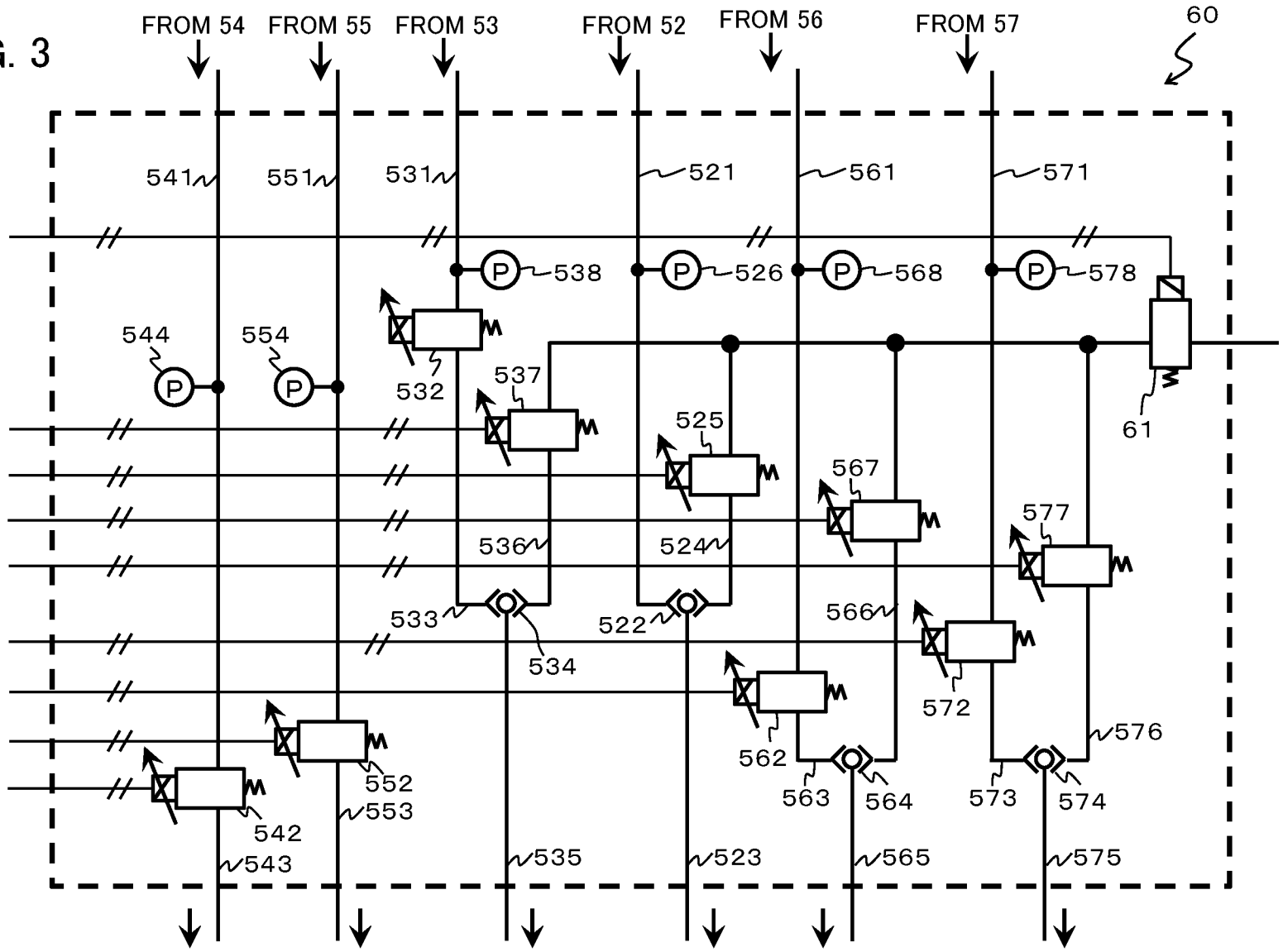
FIG. 3 is a configuration diagram of a hydraulic control unit.

FIG. 3 is a configuration diagram of the hydraulic control unit 60 shown in FIG. 2.

As shown in FIG. 3, the hydraulic control unit 60 includes a solenoid shut-off valve 61, shuttle valves 522, 534, 564, and 574, and solenoid proportional valves 525, 532, 537, 542, 552, 562, 567, 572, and 577.

An inlet port of the solenoid shut-off valve 61 is connected to an outlet port of the lock valve 51 (see FIG. 2). An outlet port of the solenoid shut-off valve 61 is connected to inlet ports of the solenoid proportional valves 525, 537, 567, and 577. The opening degree of the solenoid shut-off valve 61 is set at zero when the solenoid shut-off valve 61 is not energized. The opening degree of the solenoid shut-off valve 61 is maximized by the supply of a current from the controller 20. When the machine control is enabled, the opening degree of the solenoid shut-off valve 61 is maximized, and the supply of the pilot primary pressure to the solenoid proportional valves 525, 537, 567, and 577 is thereby started. When the machine control is disabled, on the other hand, the opening degree of the solenoid shut-off valve 61 is set to zero, and the supply of the pilot primary pressure to the solenoid proportional valves 525, 537, 567, and 577 is thereby stopped.

Switching between the enabling and disabling of the machine control is performed on the basis of an operation signal from an MC switch 26 (see FIG. 2) provided within the cab 1C. The MC switch 26 is, for example, an alternate operation switch provided to the operation right lever 14*a* or the operation left lever 14*b*. When an operation signal to enable the machine control is input from the MC switch 26 to the controller 20, the controller 20 supplies a control current to a solenoid of the solenoid shut-off valve 61, and thereby maximizes the opening degree of the solenoid shut-off valve 61. When an operation signal to disable the machine control is input from the MC switch 26 to the controller 20, the controller 20 stops the supply of the control current to the solenoid of the solenoid shut-off valve 61, and thereby sets the opening degree of the solenoid shut-off valve 61 to zero.

The shuttle valve 522 has two inlet ports and one outlet port. The shuttle valve 522 outputs the higher of pressures input from the two inlet ports from the outlet port. One inlet port of the shuttle valve 522 is connected to the boom raising pilot pressure control valve 52 via a pilot line 521. The other inlet port of the shuttle valve 522 is connected to an outlet port of the solenoid proportional valve 525 via a pilot line 524. The outlet port of the shuttle valve 522 is connected to the shuttle block 17 via a pilot line 523.

The inlet port of the solenoid proportional valve 525 is connected to the outlet port of the solenoid shut-off valve 61. An outlet port of the solenoid proportional valve 525 is connected to the other inlet port of the shuttle valve 522 via the pilot line 524. The opening degree of the solenoid proportional valve 525 is set at zero when the solenoid proportional valve 525 is not energized. The opening degree of the solenoid proportional valve 525 is increased according to a current supplied from the controller 20. The solenoid proportional valve 525 reduces the pilot primary pressure supplied thereto via the solenoid shut-off valve 61 according to the opening degree of the solenoid proportional valve 525, and outputs the resulting pilot primary pressure to the pilot line 524. Consequently, even when no boom raising pilot pressure is supplied from the boom raising pilot pressure control valve 52 to the pilot line 521, a boom raising pilot pressure can be supplied to the pilot line 523. Incidentally, when the machine control on boom raising operation is not performed, the solenoid proportional valve 525 is set in a non-energized state, so that the opening degree of the solenoid proportional valve 525 is set at zero. At this time, the boom raising pilot pressure supplied from the boom raising pilot pressure control valve 52 is introduced into the one pilot pressure receiving portion of the boom flow control valve 16*a*, and therefore a boom raising operation according to a lever operation of the operator is enabled.

The shuttle valve 534 has two inlet ports and one outlet port. The shuttle valve 534 outputs the higher of pressures input from the two inlet ports from the outlet port. One inlet port of the shuttle valve 534 is connected to an outlet port of the solenoid proportional valve 532 via a pilot line 533. The other inlet port of the shuttle valve 534 is connected to an outlet port of the solenoid proportional valve 537 via a pilot line 536. The outlet port of the shuttle valve 534 is connected to the shuttle block 17 via a pilot line 535.

An inlet port of the solenoid proportional valve 532 is connected to the boom lowering pilot pressure control valve 53 via a pilot line 531. The outlet port of the solenoid proportional valve 532 is connected to the one inlet port of the shuttle valve 534 via the pilot line 533. The opening degree of the solenoid proportional valve 532 is maximized when the solenoid proportional valve 532 is not energized. The opening degree of the solenoid proportional valve 532 is decreased from a maximum to zero according to a current supplied from the controller 20. The solenoid proportional valve 532 reduces the boom lowering pilot pressure input thereto via the pilot line 531 according to the opening degree of the solenoid proportional valve 532, and outputs the resulting boom lowering pilot pressure to the pilot line 533. Consequently, the boom lowering pilot pressure based on the lever operation of the operator can be reduced or set at zero.

The inlet port of the solenoid proportional valve 537 is connected to the outlet port of the solenoid shut-off valve 61. The outlet port of the solenoid proportional valve 537 is connected to the other inlet port of the shuttle valve 534 via the pilot line 536. The opening degree of the solenoid proportional valve 537 is set at zero when the solenoid proportional valve 537 is not energized. The opening degree of the solenoid proportional valve 537 is increased according to a current supplied from the controller 20. The solenoid proportional valve 537 reduces the pilot primary pressure supplied thereto via the solenoid shut-off valve 61 according to the opening degree of the solenoid proportional valve 537, and outputs the resulting pilot primary pressure to the pilot line 536. Consequently, even when no boom lowering pilot pressure is supplied from the boom lowering pilot pressure control valve 53 to the pilot line 531, a boom lowering pilot pressure can be supplied to the pilot line 535. Incidentally, when the machine control on boom lowering operation is not performed, the solenoid proportional valves 532 and 537 are set in a non-energized state, so that the opening degree of the solenoid proportional valve 532 is set at a full opening degree, and the opening degree of the solenoid proportional valve 537 is set at zero. At this time, the boom lowering pilot pressure supplied from the boom lowering pilot pressure control valve 53 is introduced into the other pilot pressure receiving portion of the boom flow control valve 16*a*, and therefore a boom lowering operation according to a lever operation of the operator is enabled.

An inlet port of the solenoid proportional valve 542 is connected to the arm crowding pilot pressure control valve 54 via a pilot line 541. An outlet port of the solenoid proportional valve 542 is connected to the shuttle block 17 via a pilot line 543. The opening degree of the solenoid proportional valve 542 is maximized when the solenoid proportional valve 542 is not energized. The opening degree of the solenoid proportional valve 542 is decreased from a maximum to zero according to a current supplied from the controller 20. The solenoid proportional valve 542 reduces the arm crowding pilot pressure input thereto via the pilot line 541 according to the opening degree of the solenoid proportional valve 542, and outputs the resulting arm crowding pilot pressure to the pilot line 543. Consequently, the arm crowding pilot pressure based on the lever operation of the operator can be reduced or set at zero. Incidentally, when the machine control on arm crowding operation is not performed, the solenoid proportional valve 542 is set in a non-energized state, so that the opening degree of the solenoid proportional valve 542 is set at a full opening degree. At this time, the arm crowding pilot pressure supplied from the arm crowding pilot pressure control valve 54 is introduced into the one pilot pressure receiving portion of the arm flow control valve 16*b*, and therefore an arm crowding operation according to a lever operation of the operator is enabled.

An inlet port of the solenoid proportional valve 552 is connected to the arm dumping pilot pressure control valve via a pilot line 551. An outlet port of the solenoid proportional valve 552 is connected to the shuttle block 17 via a pilot line 553. The opening degree of the solenoid proportional valve 552 is maximized when the solenoid proportional valve 552 is not energized. The opening degree of the solenoid proportional valve 552 is decreased from a maximum to zero according to a current supplied from the controller 20. The solenoid proportional valve 552 reduces the arm dumping pilot pressure input thereto via the pilot line 551 according to the opening degree of the solenoid proportional valve 552, and outputs the resulting arm dumping pilot pressure to the pilot line 553. Consequently, the arm dumping pilot pressure based on the lever operation of the operator can be reduced or set at zero. Incidentally, when the machine control on arm dumping operation is not performed, the solenoid proportional valve 552 is set in a non-energized state, so that the opening degree of the solenoid proportional valve 552 is set at a full opening degree. At this time, the arm dumping pilot pressure supplied from the arm dumping pilot pressure control valve is introduced into the other pilot pressure receiving portion of the arm flow control valve 16*b*, and therefore an arm dumping operation according to a lever operation of the operator is enabled.

The shuttle valve 564 has two inlet ports and one outlet port. The shuttle valve 564 outputs the higher of pressures input thereto from the two inlet ports from the outlet port. One inlet port of the shuttle valve 564 is connected to an outlet port of the solenoid proportional valve 562 via a pilot line 563. The other inlet port of the shuttle valve 564 is connected to an outlet port of the solenoid proportional valve 567 via a pilot line 566. The outlet port of the shuttle valve 564 is connected to the shuttle block 17 via a pilot line 565.

An inlet port of the solenoid proportional valve 562 is connected to the bucket crowding pilot pressure control valve 56 via a pilot line 561. The outlet port of the solenoid proportional valve 562 is connected to one inlet port of the shuttle valve 564 via the pilot line 563. The opening degree of the solenoid proportional valve 562 is maximized when the solenoid proportional valve 562 is not energized. The opening degree of the solenoid proportional valve 562 is decreased from a maximum to zero according to a current supplied from the controller 20. The solenoid proportional valve 562 reduces the bucket crowding pilot pressure input thereto via the pilot line 561 according to the opening degree of the solenoid proportional valve 562, and outputs the resulting bucket crowding pilot pressure to the pilot line 563. Consequently, the bucket crowding pilot pressure based on the lever operation of the operator can be reduced or set at zero.

The inlet port of the solenoid proportional valve 567 is connected to the outlet port of the solenoid shut-off valve 61. The outlet port of the solenoid proportional valve 567 is connected to the other inlet port of the shuttle valve 564 via the pilot line 566. The opening degree of the solenoid proportional valve 567 is set at zero when the solenoid proportional valve 567 is not energized. The opening degree of the solenoid proportional valve 567 is increased according to a current supplied from the controller 20. The solenoid proportional valve 567 reduces the pilot primary pressure supplied thereto via the solenoid shut-off valve 61 according to the opening degree of the solenoid proportional valve 567, and outputs the resulting pilot primary pressure to the pilot line 566. Consequently, even when no bucket crowding pilot pressure is supplied from the bucket crowding pilot pressure control valve 56 to the pilot line 561, a bucket crowding pilot pressure can be supplied to the pilot line 565. Incidentally, when the machine control on bucket crowding operation is not performed, the solenoid proportional valves 562 and 567 are set in a non-energized state, so that the opening degree of the solenoid proportional valve 562 is set at a full opening degree, and the opening degree of the solenoid proportional valve 567 is set at zero. At this time, the bucket crowding pilot pressure supplied from the bucket crowding pilot pressure control valve 56 is introduced into the one pilot pressure receiving portion of the bucket flow control valve 16*c*, and therefore a bucket crowding operation according to a lever operation of the operator is enabled.

The shuttle valve 574 has two inlet ports and one outlet port. The shuttle valve 574 outputs the higher of pressures input thereto from the two inlet ports from the outlet port. One inlet port of the shuttle valve 574 is connected to an outlet port of the solenoid proportional valve 572 via a pilot line 573. The other inlet port of the shuttle valve 574 is connected to an outlet port of the solenoid proportional valve 577 via a pilot line 576. The outlet port of the shuttle valve 574 is connected to the shuttle block 17 via a pilot line 575.

An inlet port of the solenoid proportional valve 572 is connected to the bucket dumping pilot pressure control valve 57 via a pilot line 571. The outlet port of the solenoid proportional valve 572 is connected to one inlet port of the shuttle valve 574 via the pilot line 573. The opening degree of the solenoid proportional valve 572 is maximized when the solenoid proportional valve 572 is not energized. The opening degree of the solenoid proportional valve 572 is decreased from a maximum to zero according to a current supplied from the controller 20. The solenoid proportional valve 572 reduces the bucket dumping pilot pressure input thereto via the pilot line 571 according to the opening degree of the solenoid proportional valve 572, and supplies the resulting bucket dumping pilot pressure to the pilot line 573. Consequently, the bucket dumping pilot pressure based on the lever operation of the operator can be reduced or set at zero.

The inlet port of the solenoid proportional valve 577 is connected to the outlet port of the solenoid shut-off valve 61. The outlet port of the solenoid proportional valve 577 is connected to the other inlet port of the shuttle valve 574 via the pilot line 576. The opening degree of the solenoid proportional valve 577 is set at zero when the solenoid proportional valve 577 is not energized. The opening degree of the solenoid proportional valve 577 is increased according to a current supplied from the controller 20. The solenoid proportional valve 577 reduces the pilot primary pressure supplied thereto via the solenoid shut-off valve 61 according to the opening degree of the solenoid proportional valve 577, and supplies the resulting pilot primary pressure to the pilot line 576. Consequently, even when no bucket dumping pilot pressure is supplied from the bucket dumping pilot pressure control valve 57 to the pilot line 571, a bucket dumping pilot pressure can be supplied to the pilot line 575. Incidentally, when the machine control on bucket dumping operation is not performed, the solenoid proportional valves 572 and 577 are set in a non-energized state, so that the opening degree of the solenoid proportional valve 572 is set at a full opening degree, and the opening degree of the solenoid proportional valve 577 is set at zero. At this time, the bucket dumping pilot pressure supplied from the bucket dumping pilot pressure control valve 57 is introduced into the other pilot pressure receiving portion of the bucket flow control valve 16*c*, and therefore a bucket dumping operation according to a lever operation of the operator is enabled.

The pilot line 521 is provided with a pressure sensor 526 that senses the boom raising pilot pressure supplied from the boom raising pilot pressure control valve 52. The pilot line 531 is provided with a pressure sensor 538 that senses the boom lowering pilot pressure supplied from the boom lowering pilot pressure control valve 53. The pilot line 541 is provided with a pressure sensor 544 that senses the arm crowding pilot pressure supplied from the arm crowding pilot pressure control valve 54. The pilot line 551 is provided with a pressure sensor 554 that senses the arm dumping pilot pressure supplied from the arm dumping pilot pressure control valve 55. The pilot line 561 is provided with a pressure sensor 568 that senses the bucket crowding pilot pressure supplied from the bucket crowding pilot pressure control valve 56. The pilot line 571 is provided with a pressure sensor 578 that senses the bucket dumping pilot pressure supplied from the bucket dumping pilot pressure control valve 57. The pilot pressures sensed by the pressure sensors 526, 538, 544, 554, 568, and 578 are input to the controller 20 as operation signals indicating operation directions and operation amounts of the operation devices 15A to 15C.

As shown in FIG. 2, the controller 20 is constituted by a microcomputer including a CPU (Central Processing Unit) as an operation circuit, a ROM (Read Only Memory) 20*b* as a storage device, a RAM (Random Access Memory) 20*c* as a storage device, an input interface 20*d* and an output interface 20*e*, and other peripheral circuits. The controller 20 may be constituted by one microcomputer, or may be constituted by a plurality of microcomputers.

The ROM 20*b* is a nonvolatile memory such as an EEPROM. The ROM 20*b* stores a program that can perform various kinds of computations. That is, the ROM 20*b* is a storage medium from which the program for implementing functions of the present embodiment is readable. The RAM 20*c* is a volatile memory, and is a work memory between which and the CPU 20*a* data is directly input and output. The RAM 20*c* temporarily stores necessary data while the CPU 20*a* executes the program by computation. Incidentally, the controller 20 may further include a storage device such as a flash memory or a hard disk drive.

The CPU 20 is a processing device that expands the program stored in the ROM 20*b* into the RAM 20*c*, and executes the program by computation. The CPU 20 performs predetermined computation processing on signals captured from the input interface 20*d*, the ROM 20*b*, and the RAM 20*c* according to the program. The input interface 20*d* is supplied with signals from the MC switch 26, a posture sensor 35, a target surface setting device 36, an operation sensor 34, a position sensor 42, and the like.

The input interface 20*d* converts the input signals so that the signals can be subjected to computation by the CPU 20*a*. In addition, the output interface 20*e* generates signals for output according to a result of computation in the CPU 20*a*, and outputs the signals to the solenoid proportional valves 525, 532, 537, 542, 552, 562, 567, 572, and 577, the solenoid shut-off valve 61, a notifying device 39, and the like.

The posture sensor 35 includes the angle sensors 21 to 24 (see FIG. 1). These angle sensors 21 to 24 sense information about the posture of the hydraulic excavator 1, and output signals corresponding to the information. That is, the angle sensors 21 to 24 function as a posture sensor that senses the information about the posture of the hydraulic excavator 1.

Adoptable as the angle sensors 21, 22, and 23 are potentiometers that obtain the boom angle α, the arm angle and the bucket angle γ as information about the posture of the work device 1B, and output signals (voltages) corresponding to the obtained angles.

Adoptable as the angle sensor 24 is an IMU (Inertial Measurement Unit) that obtains angular velocities and accelerations on three orthogonal axes as information about the posture of the swing structure 12, computes a roll angle ψ of the swing structure 12 (inclination angle in the left-right direction of the swing structure 12), a pitch angle φ of the swing structure 12 (inclination angle in the forward-rearward direction of the swing structure 12), and a swing angle θ of the swing structure 12 on the basis of this information, and outputs a computation result (information about the angles ψ, φ, and θ) to the controller 20. Incidentally, the computation of the angles ψ, φ, and θ indicating the posture of the swing structure 12 may be performed by the controller 20 on the basis of the output signal of the IMU. In addition, three sensors, that is, a sensor that senses the roll angle ψ, a sensor that senses the pitch angle φ, and a sensor that senses the swing angle may be provided as the angle sensor 24.

The operation sensor 34 includes the pressure sensors 526, 538, 544, 554, 568, and 578 (sees FIG. 3).

Figure 4:
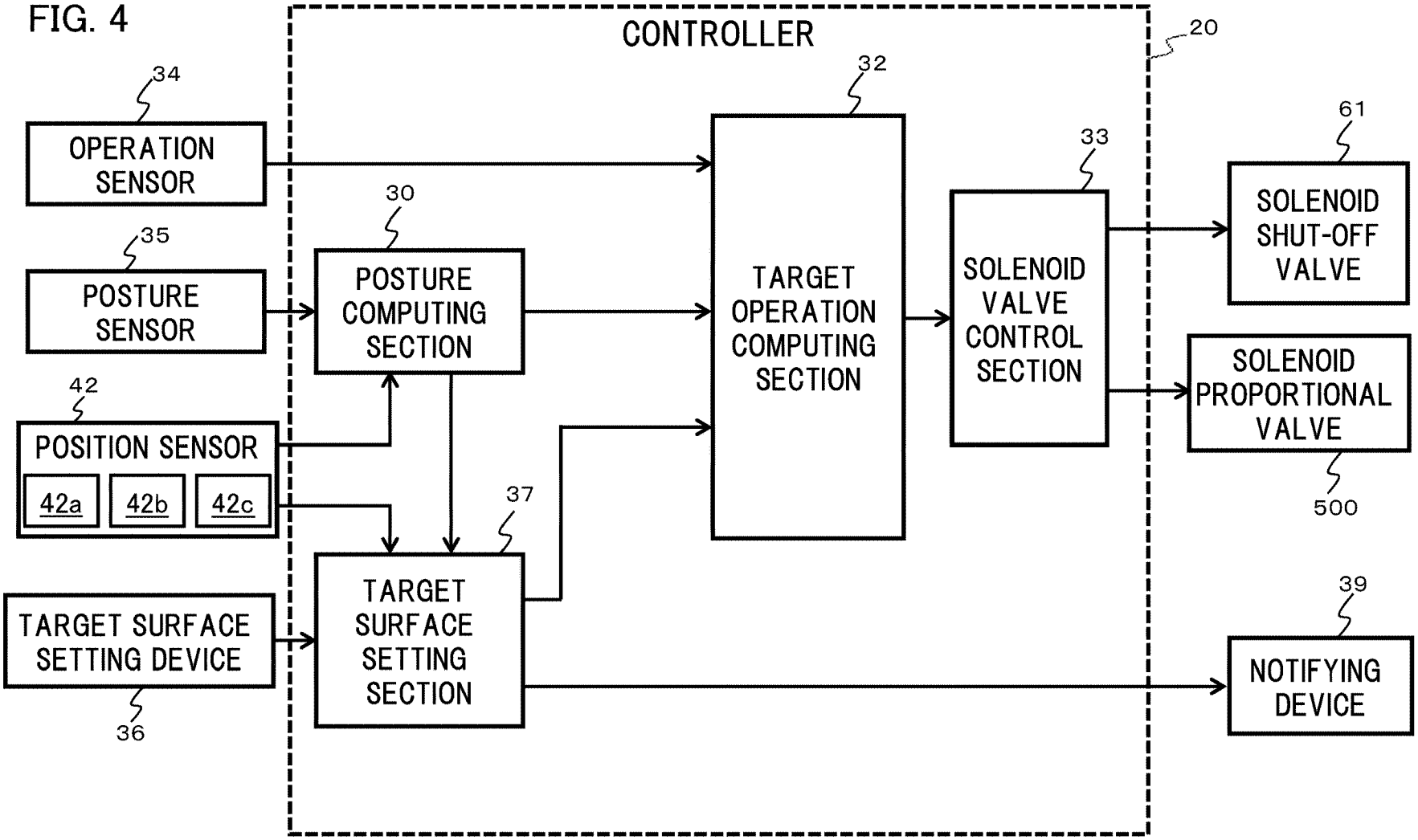
FIG. 4 is a functional block diagram of a controller.

The position sensor 42 is used to sense present position information of the swing structure 12 of the hydraulic excavator 1. As shown in FIG. 4, the position sensor 42 includes a plurality of antennas 42*a* and 42*b* for GNSS (Global Navigation Satellite Systems) (which antennas will hereinafter be written as GNSS antennas) and a positioning computing device 42*c* that computes the position and orientation of the swing structure 12 in a geographic coordinate system (global coordinate system) on the basis of satellite signals (GNSS radio waves) from a plurality of positioning satellites which satellite signals are received by the GNSS antennas 42*a* and 42*b*. The GNSS antennas 42*a* and 42*b* are provided on an upper portion of the swing structure 12 and at positions separated from each other in the left-right direction of the swing structure 12.

The GNSS antenna 42*a* receives reference position data used for computation of the position of the GNSS antenna 42*a* itself from positioning satellites. The GNSS antenna 42*b* receives reference position data used for computation of the position of the GNSS antenna 42*b* itself from positioning satellites. The GNSS antennas 42*a* and 42*b* receive the reference position data in cycles of 10 Hz, for example. Each time the GNSS antennas 42*a* and 42*b* receive the reference position data, the GNSS antennas 42*a* and 42*b* output the reference position data to the positioning computing device 42*c*.

The positioning computing device 42*c* computes a reference position P1 of the GNSS antenna 42*a* and a reference position P2 of the GNSS antenna 42*b*, the reference position P1 and the reference position P2 being expressed in the global coordinate system, on the basis of the signals (reference position data) received by the GNSS antennas 42*a* and 42*b*. The positioning computing device 42*c* computes a base line vector connecting the reference position P1 and the reference position P2 to each other. The positioning computing device 42*c* computes the position of the swing structure 12 and the orientation of the swing structure 12 on the basis of the reference positions P1 and P2 and the base line vector. The orientation of the swing structure 12 is, for example, expressed by an angle with respect to a global coordinate reference orientation (for example, the north). Each time the positioning computing device 42*c* obtains two pieces of reference position data from the GNSS antennas 42*a* and 42*b* at a frequency of 10 Hz, for example, the positioning computing device 42*c* computes the position and orientation of the swing structure 12, and outputs the position and orientation of the swing structure 12 to the controller 20.

Incidentally, the position of the swing structure 12 is an optional position of the swing structure 12, and is, for example, set at a position on the swing central axis, a position on the central axis of the boom pin 91, or the like. A storage device (for example, a ROM) of the positioning computing device 42*c* stores geometric information (dimension data or the like) indicating relation between the coordinates of the positions of the GNSS antennas 42*a* and 42*b* in a machine body coordinate system and the coordinates of the position of the swing structure 12 which position is set optional. Therefore, the positioning computing device 42*c* can compute the position coordinates and the orientation of the swing structure 12 in the geographic coordinate system on the basis of the two reference positions P1 and P2, the base line vector, and the geometric information described above.

The notifying device 39 is a device that makes a predetermined notification to the operator on the basis of a control signal from the controller 20. The notifying device 39 is, for example, a display device such as a liquid crystal display. The notifying device 39 displays a predetermined display image on a display screen on the basis of a display control signal from the controller 20. The notifying device 39 displays, on the display screen, the display image indicating, for example, a driving state of the prime mover 49, a travelling state of the track structure 11, a swing state of the swing structure 12, and the posture of the work device 1B.

The controller 20 shown in FIG. 2 performs the machine control that controls the work device 1B on the basis of a target surface St when a condition determined in advance is satisfied. In the machine control, the controller 20 outputs a control signal(s) for driving a pertinent flow control valve(s) (16*a*, 16*b*, 16*c*) to the hydraulic control unit 60. For example, the controller 20 outputs a control signal for operating the flow control valve 16*a* to the solenoid proportional valve 525 (see FIG. 3), and thereby a boom raising operation is forcibly made to be performed by extending the boom cylinder 5. The machine control includes, for example, area limiting control (ground leveling control) performed when an arm operation is performed by the operation device 15B and stop control performed when a boom lowering operation is performed by the operation device 15A with no arm operation performed.

Figure 6:
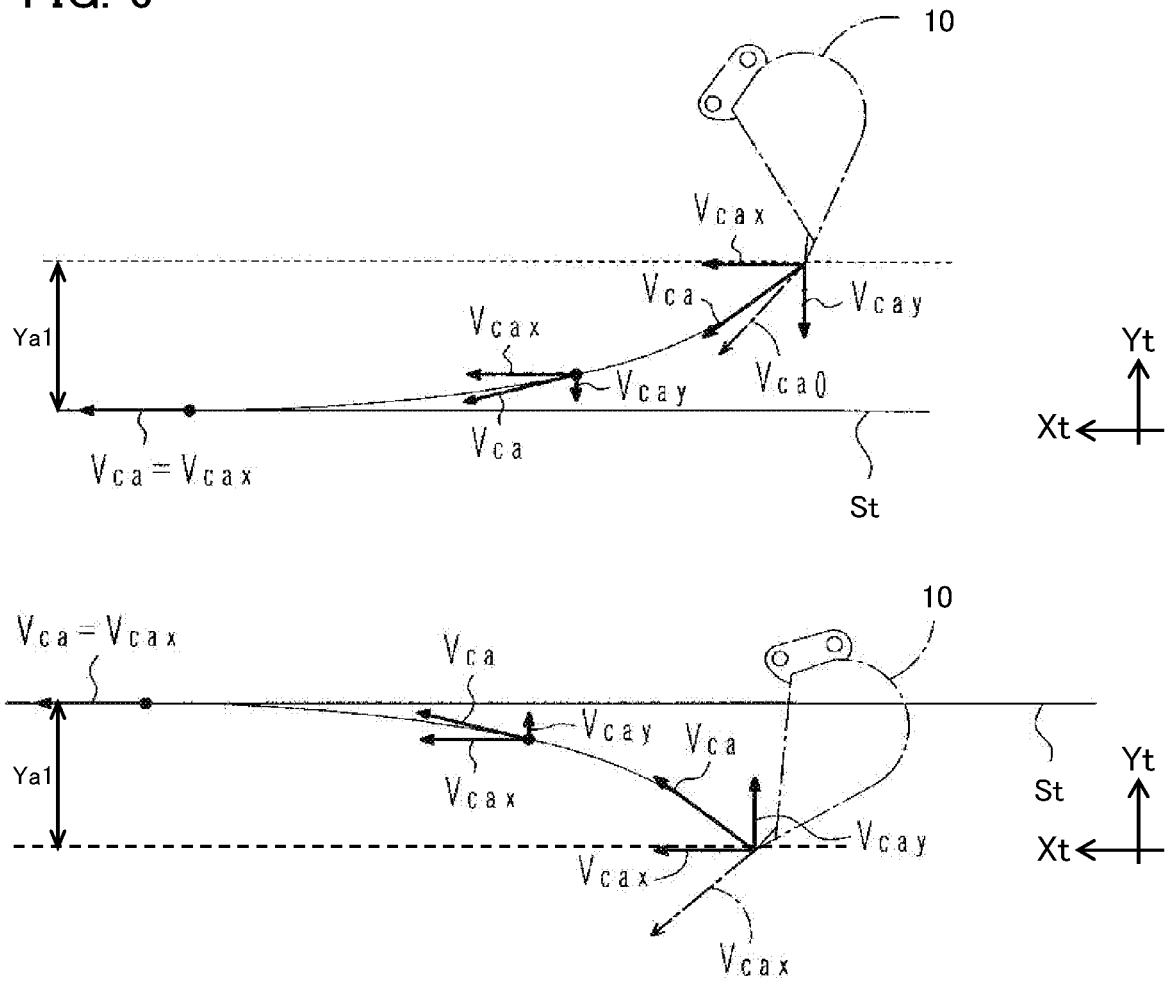
FIG. 6 is a diagram showing an example of the trajectory of a distal end portion of a bucket when the distal end portion of the bucket is controlled according to a target velocity vector Vca after correction.
Figure 7:
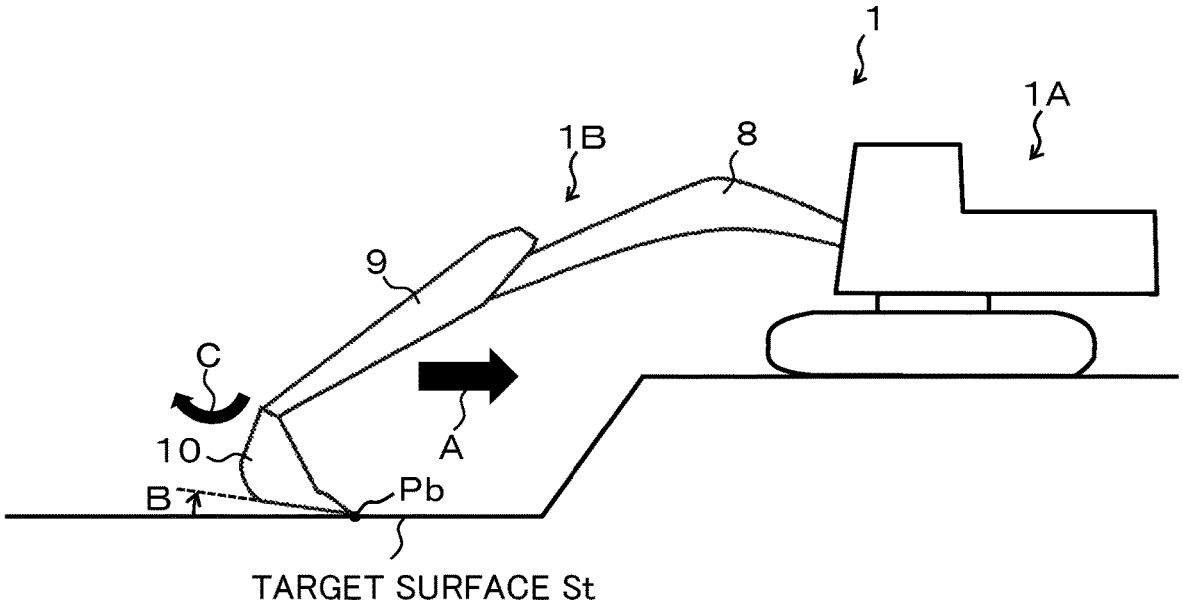
FIG. 7 is a diagram showing an example of horizontal excavating operation under machine control.

As shown in FIG. 7, the controller 20 controls at least one of the hydraulic actuators (5, 6, and 7) such that a distal end portion (for example, a claw tip) of the bucket 10 is positioned on the predetermined target surface St or above the target surface St. In the area limiting control, the operation of the work device 1B is controlled such that the distal end portion of the bucket 10 is moved along the target surface St according to an arm operation. Specifically, the controller 20 gives a boom raising or boom lowering command such that a velocity vector of the distal end portion of the bucket 10 in a direction perpendicular to the target surface St is zero while the arm operation is performed. The area limiting control is performed when a distance between the distal end portion of the bucket 10 and the target surface St (target surface distance) becomes smaller than a predetermined distance Ya1 (see FIG. 6) determined in advance in a state in which the machine control is enabled by the MC switch 26.

Incidentally, while a control point of the work device 1B which control point is used in the machine control is set at the claw tip of the bucket 10 of the hydraulic excavator 1 in the present embodiment, the control point can be changed to other than the claw tip of the bucket 10 as long as the control point is a point of a distal end part of the work device 1B. For example, the bottom surface of the bucket 10 or an outermost portion of the bucket link may be set as the control point. A configuration may be adopted in which a point of the external surface of the bucket 10 which point is at a closest distance from the target surface St is set as the control point as appropriate. The machine control includes "automatic control," in which the operation of the work device 1B is controlled by the controller 20 during non-operation of the operation devices 15A, 15B, and 15C, and "semiautomatic control," in which the operation of the work device 1B is controlled by the controller 20 only during operation of the operation devices 15A, 15B, and 15C. Incidentally, the semiautomatic control is referred to also as "intervention control" because the control by the controller 20 intervenes with operation by the operator.

FIG. 4 is a functional block diagram of the controller 20 shown in FIG. 2.

As shown in FIG. 4, the controller 20 functions as a posture computing section 30, a target surface setting section 37, a target operation computing section 32, and a solenoid valve control section 33 by executing the program stored in the ROM 20*b*. A solenoid proportional valve 500 shown in FIG. 4 is representative of the solenoid proportional valves 525, 532, 537, 542, 552, 562, 567, 572, and 577 (see FIG. 3).

The posture computing section 30 computes the posture of the hydraulic excavator 1 (posture of the work device 1B and the swing structure 12) on the basis of posture information from the posture sensor 35. The posture computing section 30 computes a position Pb of the distal end portion of the bucket 10 (for example, the claw tip of the bucket 10) in a local coordinate system (excavator reference coordinate system) (the position Pb will hereinafter be also written as a distal end position) on the basis of the posture information from the posture sensor 35 and geometric information of the work device 1B (for example, lengths L1, L2, and L3 of the driven members shown in FIG. 5) which geometric information is stored in the ROM 20*b*.

Figure 5:
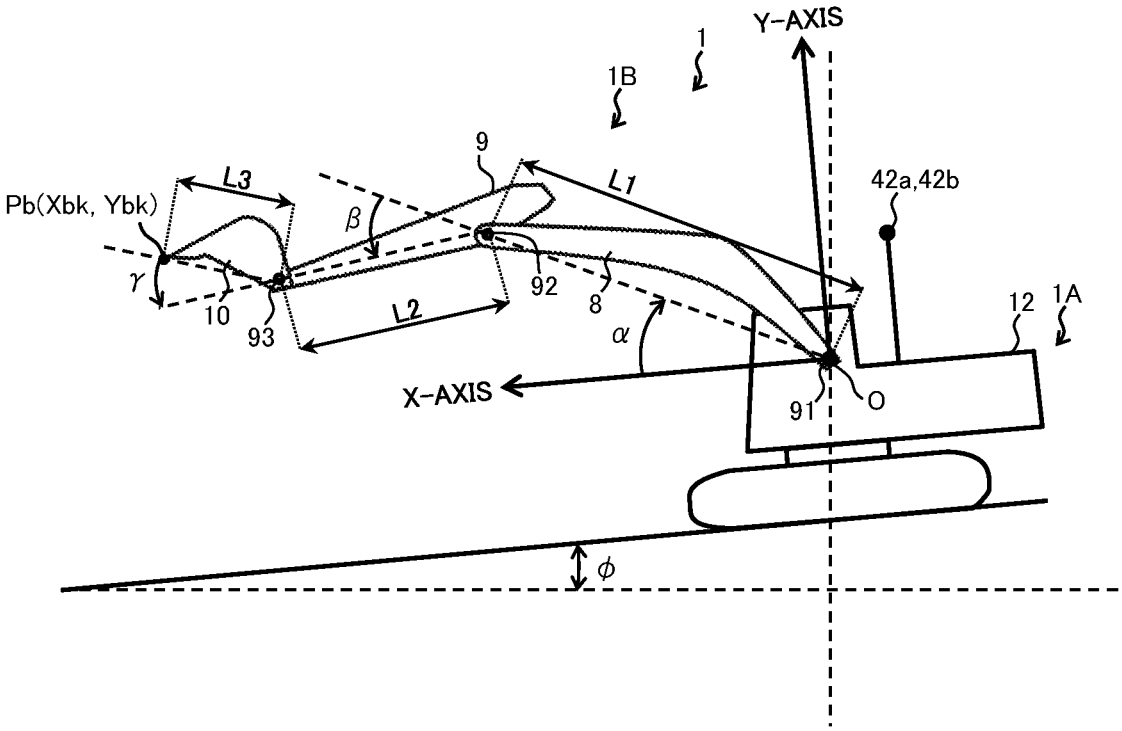
FIG. 5 is a diagram showing a coordinate system (excavator reference coordinate system) in the hydraulic excavator.

The posture of the work device 1B can be defined on the basis of the excavator reference coordinate system in FIG. 5. FIG. 5 is a diagram showing a coordinate system (excavator reference coordinate system) in the hydraulic excavator 1. The excavator reference coordinate system in FIG. 5 is a coordinate system set to the swing structure 12. In the excavator reference coordinate system, the central axis of the boom pin 91 is set as an origin O, an axis parallel with the swing central axis of the swing structure 12 is set as a Y-axis, and an axis orthogonal to the Y-axis and the boom pin 91 is set as an X-axis. The inclination angle of the boom 8 with respect to the X-axis is set as the boom angle α, the inclination angle of the arm 9 with respect to the boom 8 is set as the arm angle β, and the inclination angle of the bucket 10 with respect to the arm 9 is set as the bucket angle γ. The inclination angle in the forward-rearward direction of the machine body 1A (swing structure 12) with respect to a horizontal plane (reference plane), that is, an angle formed between the horizontal plane (reference plane) and the X-axis is set as the pitch angle φ.

The boom angle α is sensed by the angle sensor 21. The arm angle β is sensed by the angle sensor 22. The bucket angle γ is sensed by the angle sensor 23. The pitch angle φ is sensed by the angle sensor 24.

Letting L1 be a length from the central position of the boom pin 91 to the central position of the arm pin 92, letting L2 be a length from the central position of the arm pin 92 to the central position of the bucket pin 93, and letting L3 be a length from the central position of the bucket pin 93 to the distal end portion (claw tip) of the bucket 10, the distal end position Pb of the bucket 10 in the excavator reference coordinates can be expressed by the following Equations (1) and (2), where Xbk is an X-direction position, and Ybk is a Y-direction position.

[Expression 1]

$$X_{bk}=L_1 \cos \alpha+L_2 \cos(\alpha+\beta)+L_3 \cos(\alpha+\beta+\gamma) \quad (1)$$

[Expression 2]

$$Y_{bk}=L_1 \sin \alpha+L_2 \sin(\alpha+\beta)+L_3 \sin(\alpha+\beta+\gamma) \quad (2)$$

The posture computing section 30 shown in FIG. 4 computes the distal end position Pb of the bucket 10 in the global coordinate system on the basis of the distal end position Pb of the bucket 10 in the excavator reference coordinate system, the pitch angle φ of the swing structure 12, and the position and orientation of the hydraulic excavator 1 in the global coordinate system which position and orientation are computed by the positioning computing device 42*c*. That is, the posture computing section 30 transforms the distal end position Pb in the excavator reference coordinate system into the distal end position Pb in the global coordinate system.

In addition, the posture computing section 30 computes also positions or the like in the global coordinate system of the boom pin 91, the arm pin 92, and the bucket pin 93 indicating the posture of the work device 1B as well as the origin O in addition to the distal end position Pb of the bucket 10, sets these positions or the like as posture information of the hydraulic excavator 1, and outputs the posture information to the target surface setting section 37 and the target operation computing section 32. Incidentally, the posture computing section 30 sets not only the computation result but also the angle information (α, β, γ, θ, φ, and ψ) sensed by the posture sensor 35 as the posture information, and outputs the posture information to the target surface setting section 37 and the target operation computing section 32.

The target surface setting device 36 is a device for inputting, to the controller 20, target shape data used to set the target surface St used in the machine control. The target surface setting device 36 includes a storage device that stores three-dimensional target shape data defined in the global coordinate system (absolute coordinate system). The target surface setting section 37 obtains the three-dimensional target shape data from the target surface setting device 36, and sets the target surface St on the basis of the obtained target shape data and the posture information from the posture computing section 30 (information indicating the posture of the hydraulic excavator 1 in the global coordinate system). The target surface setting section 37 generates, as a two-dimensional target surface, a sectional shape obtained by sectioning the target shape data by a plane in which the work device 1B moves (operation plane (X-Y plane) of the work device 1B).

On the basis of information from the posture computing section 30, the target surface setting section 37, and the operation sensor 34, the target operation computing section 32 computes target operation of the work device 1B such that the bucket 10 moves without penetrating the target surface St.

Specifically, the target operation computing section 32 computes a target velocity of each hydraulic cylinder (5, 6, and 7) on the basis of the target surface St set by the target surface setting section 37, the computation result (posture information) of the posture computing section 30, and the sensing result (operation information) of the operation sensor 34. The target operation computing section 32 computes the target velocity of each hydraulic cylinder (5, 6, and 7) so as not to excavate the lower side of the target surface St by the work device 1B in the machine control. In the following, description will be made in detail with reference to FIG. 6. FIG. 6 is a diagram showing an example of the trajectory of the distal end portion of the bucket 10 when the distal end portion of the bucket 10 is controlled according to a target velocity vector Vca after correction. In the description here, as shown in FIG. 6, an Xt axis and a Yt axis are set. The Xt axis is an axis parallel with the target surface St. The Yt axis is an axis orthogonal to the target surface St.

The target operation computing section 32 computes the target velocity (primary target velocity) of each hydraulic cylinder (5, 6, and 7) on the basis of the operation amounts of the operation devices 15A, 15B, and 15C. Next, the target operation computing section 32 computes a target velocity vector Vca0 of the distal end portion of the bucket 10 on the basis of the target velocity (primary target velocity) of each hydraulic cylinder (5, 6, and 7), the posture information of the hydraulic excavator 1 which posture information includes the distal end position Pb of the bucket 10, the distal end position Pb being computed by the posture computing section 30, and dimensions (L1, L2, L3, and the like) of each part of the work device 1B which dimensions are stored in the ROM 20*b*. In addition, the target operation computing section 32 computes a distance (target surface distance) in a Yt axis direction between the distal end position Pb of the bucket 10, the distal end position Pb being computed by the posture computing section and the target surface St set by the target surface setting section 37.

The target operation computing section 32 computes a secondary target velocity by correcting the primary target velocity (velocities) of a necessary hydraulic cylinder(s) among the hydraulic cylinders (5, 6, and 7) such that a component Vcay perpendicular to the target surface St (velocity component in the Yt axis direction) in the target velocity vector Vca0 of the distal end portion of the bucket approaches 0 (zero) as the target surface distance approaches 0 (zero). The target operation computing section 32 thereby performs control (direction changing control) that converts the velocity vector of the distal end portion of the bucket 10 into Vca. The target velocity vector Vca when the target surface distance is 0 (zero) includes only a component Vcax parallel with the target surface St (velocity component in an Xt axial direction). The distal end portion (control point) of the bucket 10 is thereby retained so as to be positioned on the target surface St or above the target surface St.

When an arm crowding operation is performed singly, and the target surface distance becomes equal to or less than the predetermined distance Ya1 (that is, the distal end portion of the bucket 10 enters a set region formed by the target surface St and a plane separated from the target surface St in the Yt axis direction by Ya1), for example, the target operation computing section 32 performs the direction changing control that converts the velocity vector Vca0 into Vca by expanding the arm cylinder 6 and expanding the boom cylinder 5.

Incidentally, the direction changing control may be performed by a combination of boom raising or boom lowering and arm crowding, and may be performed by a combination of boom raising or boom lowering and arm dumping. In either case, when the target velocity vector Vca includes a downward component (Vcay<0) for approaching the target surface St in a state in which the distal end portion of the bucket 10 is positioned above the target surface St, the target operation computing section 32 computes the target velocity of the boom cylinder 5 in a boom raising direction of canceling the downward component. Conversely, when the target velocity vector Vca includes an upward component (Vcay>0) for separating from the target surface St, the target operation computing section 32 computes the target velocity of the boom cylinder 5 in a boom lowering direction of canceling the upward component. In addition, when the target velocity vector Vca includes an upward component (Vcay>0) for approaching the target surface St in a state in which the distal end portion of the bucket 10 is positioned below the target surface St, the target operation computing section 32 computes the target velocity of the boom cylinder 5 in a boom lowering direction of canceling the upward component. Conversely, when the target velocity vector Vca includes an upward component (Vcay<0) for separating from the target surface St, the target operation computing section 32 computes the target velocity of the boom cylinder 5 in a boom raising direction of canceling the downward component.

The solenoid valve control section 33 outputs commands to the solenoid shut-off valve 61 and the solenoid proportional valve 500 on the basis of a computation result of the target operation computing section 32 (target velocity of each hydraulic cylinder).

Referring to FIG. 7, description will be made of an example of operation of the hydraulic excavator 1 when the machine control is performed. FIG. 7 is a diagram showing an example of horizontal excavating operation under the machine control.

When the operator performs a boom lowering single operation by the operation device 15A in order to dispose the bucket 10 at a predetermined position (excavation start position) at a time of a start of excavation work, the controller 20 performs stop control. When the bucket 10 approaches the target surface St, the controller 20 reduces the velocity of the boom 8 by controlling the solenoid proportional valve 532 (see FIG. 3) such that the bucket 10 does not enter the lower side of the target surface St. In a state in which the bucket 10 has reached the target surface St, the controller 20 controls the solenoid proportional valve 532 (see FIG. 3) such that the velocity of the boom 8 is zero.

When the operator operates the operation device 15B to perform horizontal excavation by an operation of pulling the arm 9 in the direction of an arrow A (crowding operation), the controller 20 performs the area limiting control. The controller 20 automatically performs an operation of raising the boom 8 by controlling the solenoid proportional valve 525 (see FIG. 3) such that the distal end portion of the bucket 10 does not enter the lower side of the target surface St. At this time, for an improvement in excavation accuracy, the velocity of the arm 9 may be reduced as required by controlling the solenoid proportional valve 542 (see FIG. 3). Incidentally, in order to make an angle B of the bucket 10 with respect to the target surface St a constant value, and thereby facilitate leveling work, the controller 20 may automatically rotate the bucket 10 in the direction of an arrow C by controlling the solenoid proportional valve 577 (see FIG. 3).

When the bucket 10 enters the lower side of the target surface St while the horizontal excavation is performed by the operation of pulling the arm 9 in the direction of the arrow A, the controller 20 automatically performs an operation of raising the boom 8 by controlling the solenoid proportional valve 525 (see FIG. 3) so that the bucket 10 returns to above the target surface St.

The controller 20 thus controls the operation of the work device 1B such that the distal end portion (claw tip) of the bucket 10 moves along the target surface St.

Incidentally, a change in weather conditions as in a case where the sky over the swing structure 12 is covered with a thick cloud or the like may weaken satellite signals (GNSS radio waves) from positioning satellites which satellite signals are received by the GNSS antennas 42*a* and 42*b*. When communication conditions of the GNSS antennas 42*a* and 42*b* are degraded, the positioning computing device 42*c* cannot compute the position and orientation of the swing structure 12 with high accuracy. In this case, the positioning computing device 42*c* outputs a position sensing error signal to the controller 20. As a result, the controller 20 cannot compute the operation plane of the work device 1B, and cannot update the target surface St on the basis of the present posture information of the hydraulic excavator 1.

Accordingly, when the communication conditions of the GNSS antennas 42*a* and 42*b* are degraded and the controller 20 becomes unable to obtain the position information of the swing structure 12 by the position sensor 42 during execution of the machine control, the controller 20 according to the present embodiment stores, as reference swing angle information (reference swing angle θ0), swing angle information (swing angle θ) of the swing structure 12, the swing angle information being sensed by the posture sensor 35 at that time, and generates anew a temporary target surface on the basis of the target surface generated when the communication conditions were good (normal time target surface). When the swing structure 12 is positioned outside a swing range Sr determined on the basis of the reference swing angle information (reference swing angle θ0), the controller 20 prohibits the execution of the machine control on the basis of the temporary target surface. When the swing structure 12 is positioned inside the swing range Sr, the controller 20 permits the execution of the machine control on the basis of the temporary target surface.

In the following, referring to FIGS. 8 to 13, detailed description will be made of contents of control from a time that the controller 20 becomes unable to obtain the position information of the swing structure 12 (position and orientation of the swing structure 12) due to a degradation in the communication conditions to a time that the controller 20 becomes able to obtain the position information of the swing structure 12 (position and orientation of the swing structure 12) due to a restoration of the communication conditions.

Figure 8:
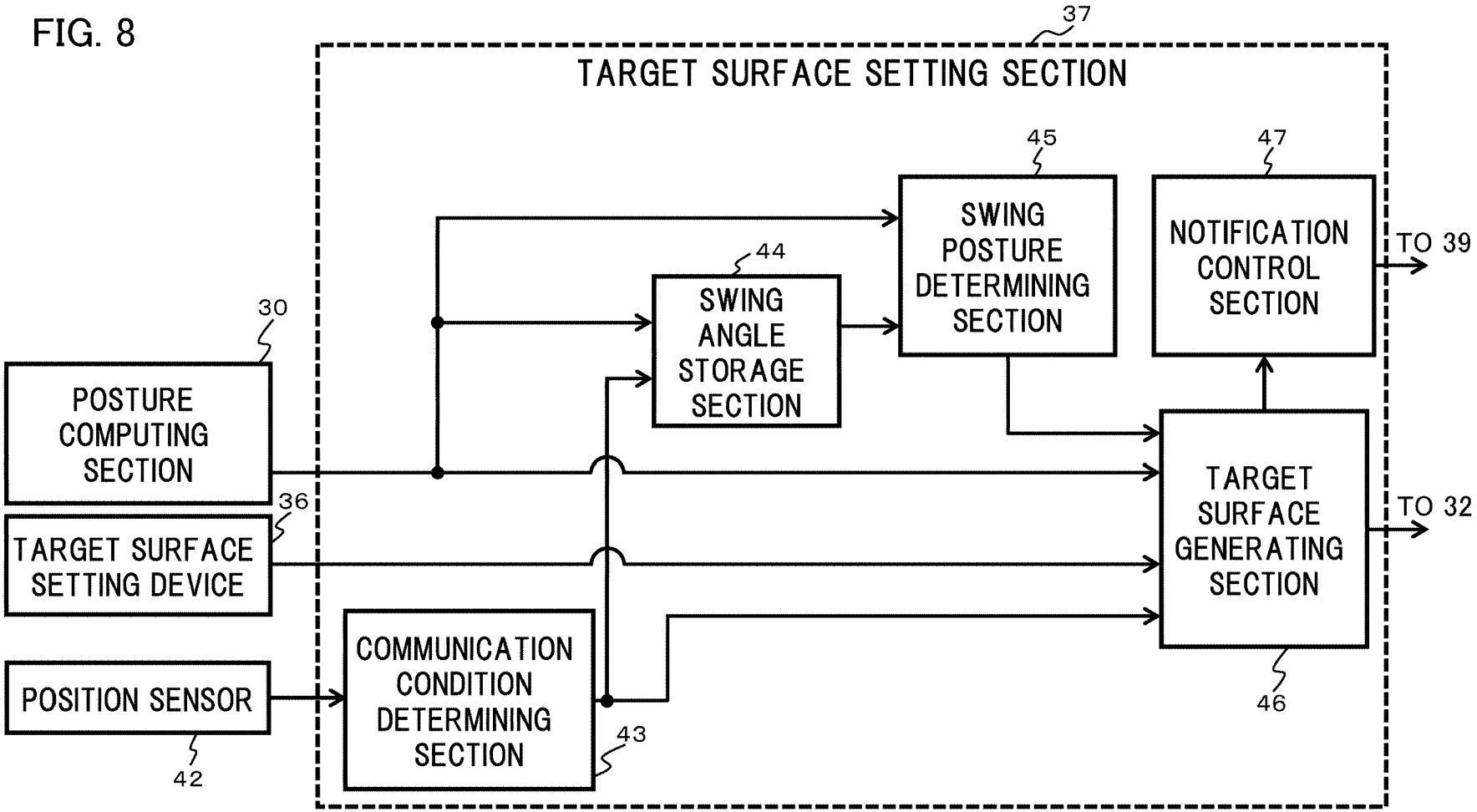
FIG. 8 is a diagram of assistance in explaining details of functions of a target surface setting section.

FIG. 8 is a diagram of assistance in explaining details of functions of the target surface setting section 37. As shown in FIG. 8, the target surface setting section 37 functions as a communication condition determining section 43, a swing angle storage section 44, a swing posture determining section 45, a target surface generating section 46, and a notification control section 47.

The communication condition determining section 43 determines whether or not the communication conditions of the GNSS antennas 42*a* and 42*b* are good on the basis of information output from the position sensor 42. In the present embodiment, when a position sensing error signal is input from the position sensor 42 to the controller 20, the communication condition determining section 43 determines that the communication conditions are not good (that is, information about the position and orientation of the swing structure 12 cannot be obtained). When the position sensing error signal is not input to the controller 20, the communication condition determining section 43 determines that the communication conditions are good (that is, the information about the position and orientation of the swing structure 12 can be obtained).

A degradation in the communication conditions of the GNSS antennas 42*a* and 42*b* decreases accuracy of computation of the position and orientation of the swing structure 12 by the positioning computing device 42*c* of the position sensor 42. Therefore, the communication conditions of the GNSS antennas 42*a* and 42*b* can be estimated on the basis of the accuracy of the computation in the positioning computing device 42*c*.

The positioning computing device 42*c* determines whether or not the accuracy of the computation of the positions of the GNSS antennas 42*a* and 42*b* (that is, the position of the swing structure 12) is a tolerable accuracy. When the accuracy of the computation of the positions of the GNSS antennas 42*a* and 42*b* is a tolerable accuracy, the positioning computing device 42*c* does not output the position sensing error signal to the controller 20, but outputs information about the computed position and orientation of the swing structure 12 to the controller 20. When the accuracy of the computation of the positions of the GNSS antennas 42*a* and 42*b* is not a tolerable accuracy, the positioning computing device 42*c* does not output the information about the position and orientation of the swing structure 12 to the controller 20, but outputs the position sensing error signal to the controller 20.

Incidentally, various methods can be adopted as a method for evaluating the accuracy of the computation of the positions of the GNSS antennas 42*a* and 42*b*. In the following, description will be made of an example of a method for evaluating the accuracy of the computation of the positions of the GNSS antennas 42*a* and 42*b*. The accuracy of the computation of the positions of the GNSS antennas 42*a* and 42*b* varies according to the number and arrangement of positioning satellites whose signals (radio waves) can be received by the GNSS antennas 42*a* and 42*b*. An effect of the conditions of the number and arrangement of the positioning satellites on the accuracy of the computation of the positions of the GNSS antennas 42*a* and 42*b* can be expressed by DOP (Dilution of Precision: an accuracy decrease rate), for example. The smaller the number of the positioning satellites, and the shorter the distance between the positioning satellites, the lower the accuracy of the computation of the positions of the GNSS antennas 42*a* and 42*b*. The positioning computing device 42*c* computes an accuracy evaluation parameter on the basis of information about the number of the positioning satellites and the arrangement of the positioning satellites. The accuracy evaluation parameter is a parameter that increases as the computation accuracy becomes higher.

In addition, the positioning computing device 42*c* computes an index indicating a degree of variation of data in statistics (a variance, a standard deviation, or the like). When the above-described accuracy evaluation parameter is equal to or more than a predetermined threshold value, and the index indicating a degree of variation of a result of computing the position and orientation of the swing structure 12 is less than a predetermined threshold value, the positioning computing device 42*c* determines that the accuracy of the computation of the positions of the GNSS antennas 42*a* and 42*b* is a tolerable accuracy. On the other hand, when the above-described accuracy evaluation parameter is less than the predetermined threshold value, or when the index indicating the degree of variation of the result of computing the position and orientation of the swing structure 12 is equal to or more than the predetermined threshold value, the positioning computing device 42*c* determines that the accuracy of the computation of the positions of the GNSS antennas 42*a* and 42*b* is not a tolerable accuracy.

Incidentally, the positioning computing device 42*c* may determine whether or not the accuracy of the computation of the positions of the GNSS antennas 42*a* and 42*b* is a tolerable accuracy on the basis of a signal strength expressed by a carrier/noise ratio (C/No).

When the communication condition determining section 43 determines that the communication conditions of the GNSS antennas 42*a* and 42*b* are not good, the swing angle storage section 44 stores the swing angle θ at that time as the reference swing angle θ0 in the ROM 20*b*. In other words, when a transition is made from a state in which the information about the position and orientation of the swing structure 12 can be obtained to a state in which the information about the position and orientation of the swing structure 12 cannot be obtained, the swing angle storage section 44 stores the swing angle θ at that time as the reference swing angle θ0 in the ROM 20*b*.

Figure 9:
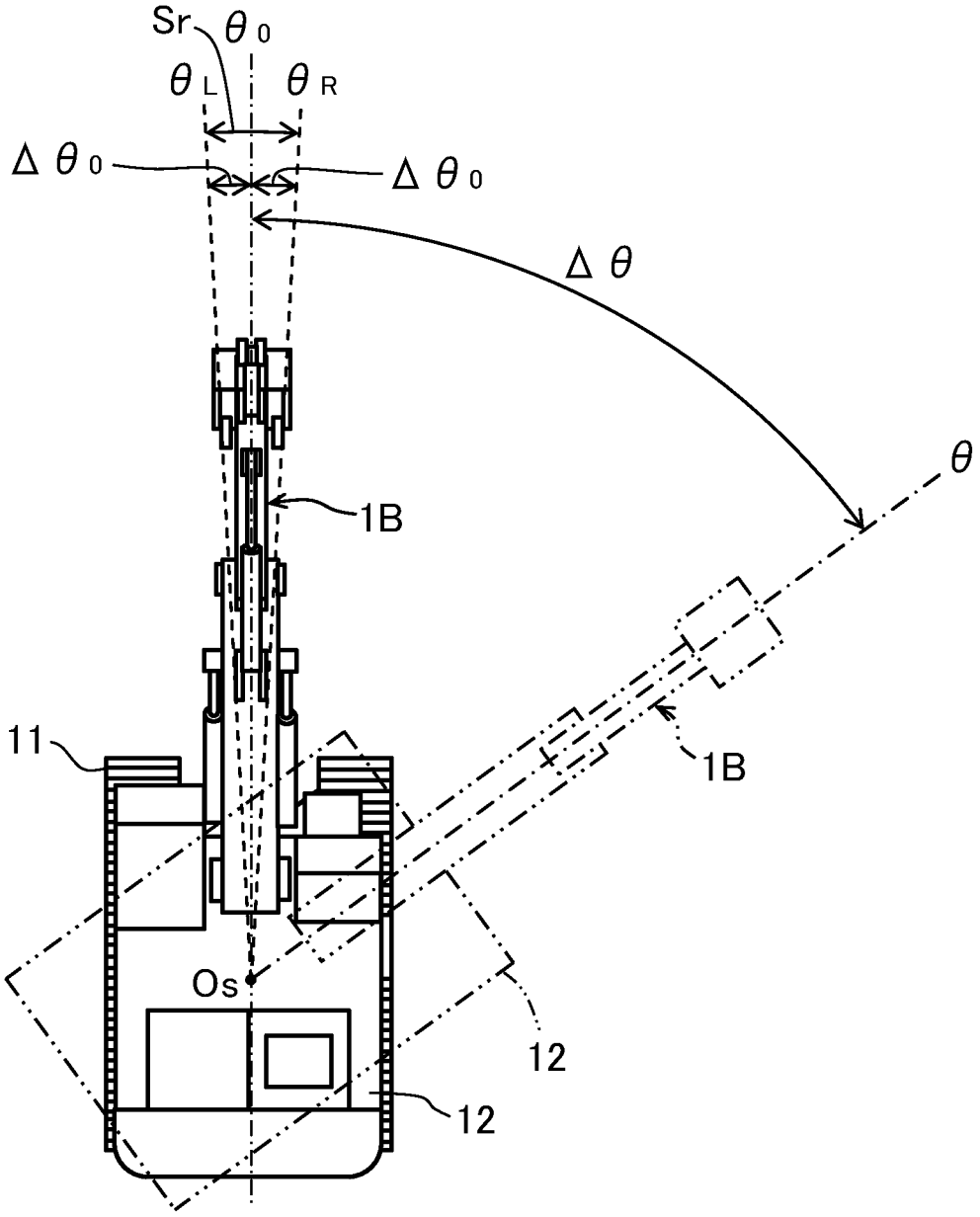
FIG. 9 is a diagram of assistance in explaining contents of swing posture determination processing by a swing posture determining section.

The swing posture determining section 45 determines whether the swing structure 12 is positioned outside the swing range Sr determined on the basis of the reference swing angle θ0 or is positioned inside the swing range Sr. FIG. 9 is a diagram of assistance in explaining contents of swing posture determination processing by the swing posture determining section 45, and is a diagram of the swing structure 12 as viewed from above.

As shown in FIG. 9, the swing posture determining section 45 computes a difference Δθ between the swing angle θ sensed by the posture sensor 35 and the reference swing angle θ0 stored in the ROM 20*b*. The difference Δθ is expressed as the absolute value of a value obtained by subtracting the reference swing angle θ0 from the swing angle θ ($\Delta\theta=|\theta-\theta 0|$). The swing posture determining section 45 determines whether the swing structure 12 is positioned outside the swing range Sr or is positioned inside the swing range Sr on the basis of magnitude relation between the difference Δθ and a predetermined value Δθ0.

The predetermined value Δθ0 is a threshold value for defining the swing range Sr, and is stored in the ROM 20*b* in advance. A position rotated clockwise in the figure from the reference swing angle θ0 by the predetermined value Δθ0 is a right end OR of the swing range Sr. A position rotated counterclockwise in the figure from the reference swing angle θ0 by the predetermined value Δθ0 is a left end θL of the swing range Sr. It is preferable to set, as the predetermined value Δθ0, a value such that the swing range Sr falls inside a range defined by connecting both of a left and a right end of the bucket 10 to a swing central axis θs in a state in which the work device 1B is most extended forward. A value of about 0.5 degrees to 1 degree, for example, is set as the predetermined value Δθ0.

When the difference Δθ is larger than the predetermined value Δθ0, the swing posture determining section 45 determines that the swing structure 12 is positioned outside the swing range Sr. When the difference Δθ is equal to or less than the predetermined value Δθ0, the swing posture determining section 45 determines that the swing structure 12 is positioned inside the swing range Sr.

When the communication condition determining section 43 determines that the communication conditions of the GNSS antennas 42*a* and 42*b* are good, the target surface generating section 46 shown in FIG. 8 generates a normal time target surface Sta, and stores the normal time target surface Sta in the ROM 20*b*. When the communication condition determining section 43 determines that the communication conditions of the GNSS antennas 42*a* and 42*b* are not good, the target surface generating section 46 generates a temporary target surface Stb as a new target surface on the basis of the normal time target surface Sta generated when the communication conditions were good, and the target surface generating section 46 stores the temporary target surface Stb in the ROM 20*b*.

The target surface generating section 46 generates, as the normal time target surface Sta (two-dimensional target surface), a sectional shape obtained by sectioning the three-dimensional target shape data obtained from the target surface setting device 36 by the plane in which the work device 1B moves (operation plane (X-Y plane) of the work device 1B) on the basis of the posture information from the posture computing section 30 (information about the posture of the work device 1B in the global coordinate system). Incidentally, the operation plane of the work device 1B can be computed on the basis of, for example, the positions of the boom pin 91, the arm pin 92, and the bucket pin 93. The target surface generating section 46 sets the generated normal time target surface Sta as the target surface St to be used in the machine control.

Figure 10A:
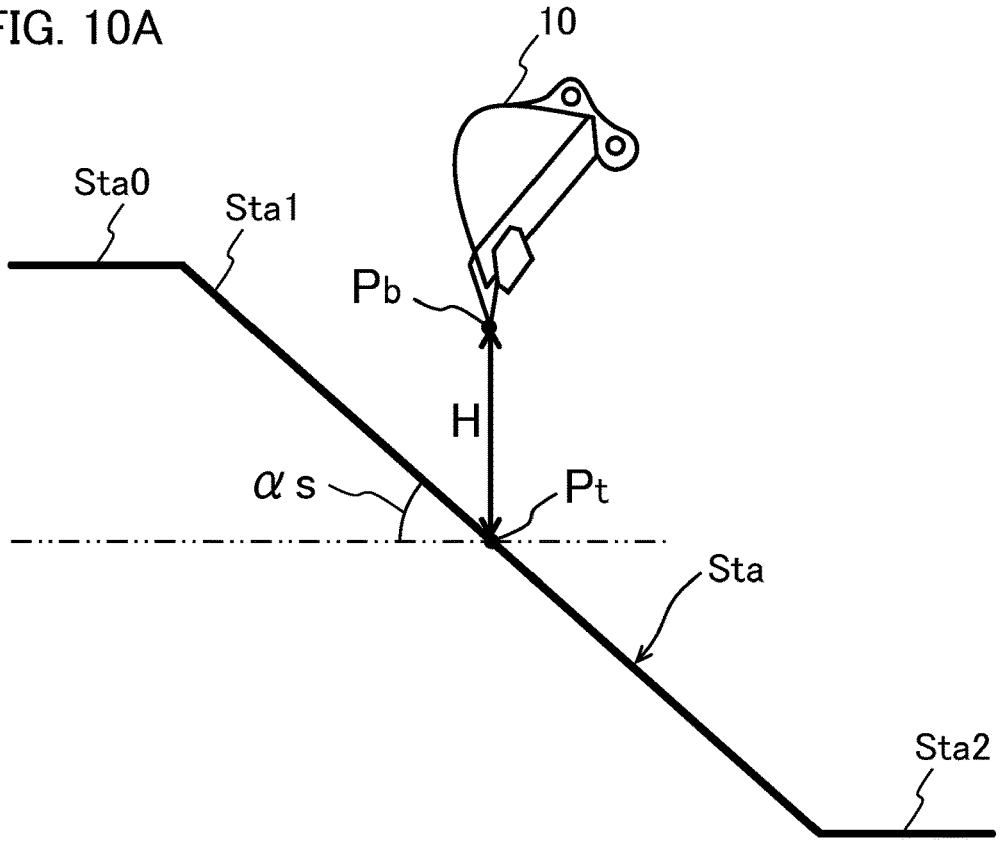
FIG. 10A is a diagram of assistance in explaining contents of processing of generating a temporary target surface by a target surface generating section, and shows a gradient as of a target surface.
Figure 10B:
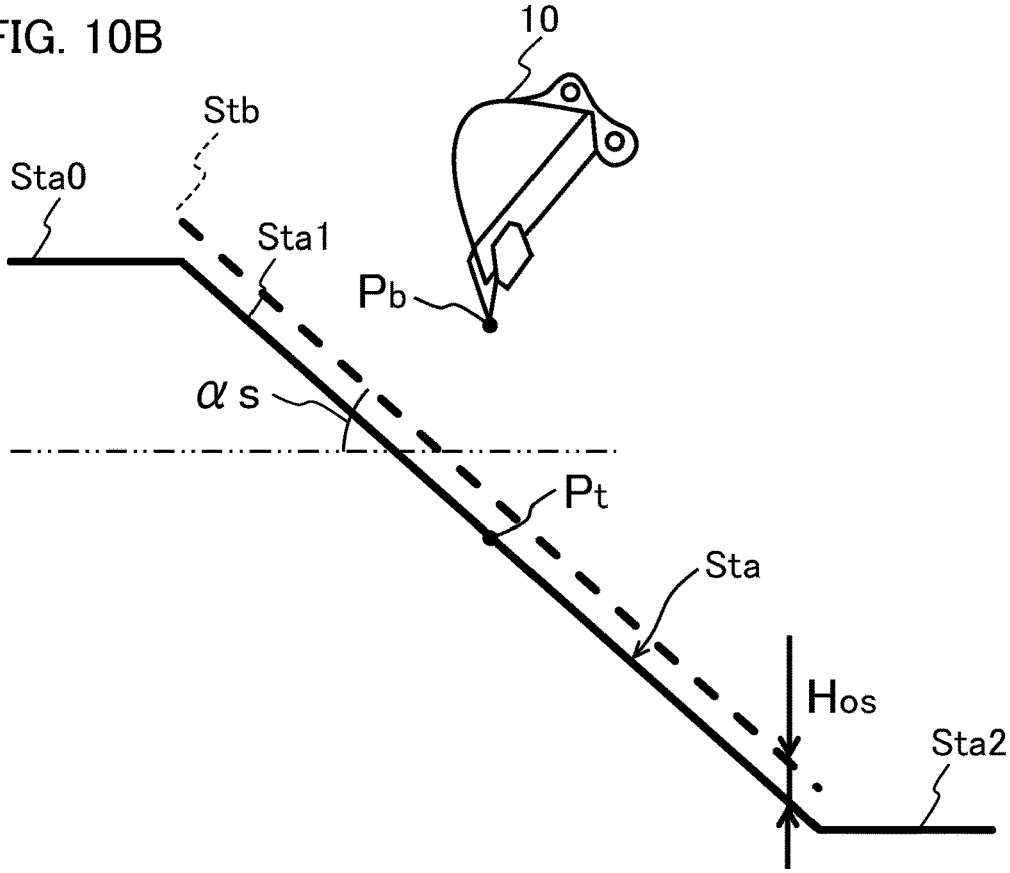
FIG. 10B is a diagram of assistance in explaining the contents of the processing of generating the temporary target surface by the target surface generating section, and shows a temporary target surface Stb.

FIG. 10A and FIG. 10B are diagrams of assistance in explaining contents of processing of generating the temporary target surface Stb by the target surface generating section 46. FIG. 10A shows a gradient as of the target surface. FIG. 10B shows the temporary target surface. As shown in FIG. 10A, in the present embodiment, the normal time target surface Sta formed by connecting a plurality of target surface elements Sta0, Sta1, and Sta2 to one another is set.

As shown in FIG. 10A, the target surface generating section 46 sets, as a control position Pt, a point of intersection of a straight line drawn downward in a vertical direction (direction of gravity) from the distal end position Pb of the bucket 10 and the normal time target surface Sta. In the example shown in FIG. 10A, the control position Pt is set in the target surface element Sta1 among the plurality of target surface elements Sta0, Sta1, and Sta2. The target surface generating section 46 sets, as the gradient as of the normal time target surface Sta, an angle formed between the target surface element Sta1 including the control position Pt and a horizontal plane (reference plane) indicated by a chain double-dashed line. As shown in FIG. the target surface generating section 46 generates the temporary target surface Stb having the same gradient as as the target surface element Sta1. The temporary target surface Stb is generated at a position offset upward in a vertical direction from the target surface element Sta1 by a predetermined offset amount Hos.

Figure 11:
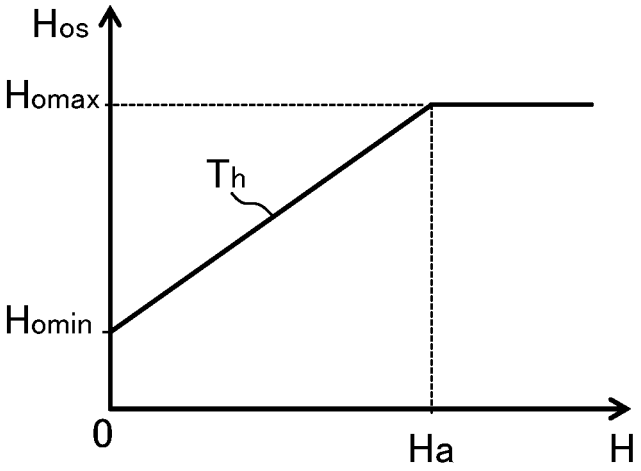
FIG. 11 is a diagram showing relation between a vertical distance H and an offset amount Hos.

As shown in FIG. 10A, the target surface generating section 46 computes a distance H in the vertical direction between the distal end position Pb of the bucket 10 and the control position Pt (which distance will hereinafter be also written as a vertical distance), and computes the offset amount Hos in the vertical direction on the basis of the vertical distance H. FIG. 11 is a diagram showing relation between the vertical distance H and the offset amount Hos. The ROM 20*b* stores a table Th that associates the vertical distance H and the offset amount Hos with each other, the table Th being shown in FIG. 11. The table Th has the following characteristics: the offset amount Hos is a minimum offset amount Homin when the vertical distance H is (zero), the offset amount Hos is increased as the vertical distance H is increased, and the offset amount Hos is a maximum offset amount Homax when the vertical distance H is equal to or more than a predetermined value Ha. For example, the minimum offset amount Homin is a value larger than 0 (zero), and the maximum offset amount Homax is a value smaller than (Ya1)/(cos(αs)).

The target surface generating section 46 refers to the table Th, and computes the offset amount Hos on the basis of the vertical distance H. The target surface generating section 46 stores the temporary target surface Stb offset by the offset amount Hos in the ROM 20*b*. When the communication condition determining section 43 determines that the communication conditions of the GNSS antennas 42*a* and 42*b* are good after the target surface generating section 46 stores the temporary target surface Stb in the ROM 20*b*, the target surface generating section 46 erases the data of the temporary target surface Stb from the ROM 20*b*.

The target surface generating section 46 shown in FIG. 8 enables the temporary target surface Stb when the swing posture determining section 45 determines that the swing structure 12 is positioned inside the swing range Sr. That is, when the swing structure 12 is positioned inside the swing range Sr, the target surface generating section 46 sets the temporary target surface Stb as the target surface St to be used in the machine control. Because the temporary target surface Stb is set as the target surface St, the machine control based on the target surface St (temporary target surface Stb) is performed when the distance between the target surface St and the distal end position Pb of the bucket 10 (target surface distance) becomes equal to or less than the predetermined distance Ya1. The controller 20 thus permits the execution of the machine control based on the target surface St when the swing structure 12 is positioned inside the swing range Sr.

When the swing posture determining section 45 determines that the swing structure 12 is positioned outside the swing range Sr, the target surface generating section 46 disables the temporary target surface Stb. In the present embodiment, when the swing structure 12 is positioned outside the swing range Sr, the target surface generating section 46 determines that the target surface St to be used in the machine control is not present, and sets an invalid value stored in the ROM 20*b* in advance as the target surface distance. As the invalid value, a value larger than at least the predetermined distance Ya1 is set. Consequently, the machine control is not performed even when the distance between the target surface St and the distal end position Pb of the bucket 10 (target surface distance) becomes equal to or less than the predetermined distance Ya1. The controller thus prohibits the execution of the machine control based on the target surface St when the swing structure 12 is positioned outside the swing range Sr.

The notification control section 47 notifies the notifying device 39 whether the swing structure 12 is positioned outside the swing range Sr or is positioned inside the swing range Sr when the position information of the swing structure 12 is unable to be obtained by the position sensor 42 during the execution of the machine control. The notification control section 47 monitors whether the target surface generating section 46 has set the temporary target surface Stb in an enabled state or has set the temporary target surface Stb in a disabled state. As described above, when the position information of the swing structure 12 is unable to be obtained by the position sensor 42, and the swing structure 12 is positioned inside the swing range Sr, the temporary target surface Stb is set in an enabled state. In addition, when the position information of the swing structure 12 is unable to be obtained by the position sensor 42, and the swing structure 12 is positioned outside the swing range Sr, the temporary target surface Stb is set in a disabled state.

When the temporary target surface Stb is set in an enabled state during the execution of the machine control, the notification control section 47 outputs a control signal (notification command) to the notifying device 39 to display a message such as "The communication level has decreased. The machine control based on the temporary target surface can be performed." on the display screen of the notifying device (display device) 39. In addition, when the temporary target surface Stb is set in a disabled state during the execution of the machine control, the notification control section 47 outputs a control signal (notification command) to the notifying device 39 to display a message such as "The communication level has decreased. The machine control based on the temporary target surface cannot be performed. Please swing the swing structure to the original position." on the display screen of the notifying device (display device) 39. Incidentally, the notification control section 47 may display the present position of the swing structure 12 and a display image showing the swing range Sr on the display screen of the notifying device (display device) 39 together with the above-described messages.

Figure 12:
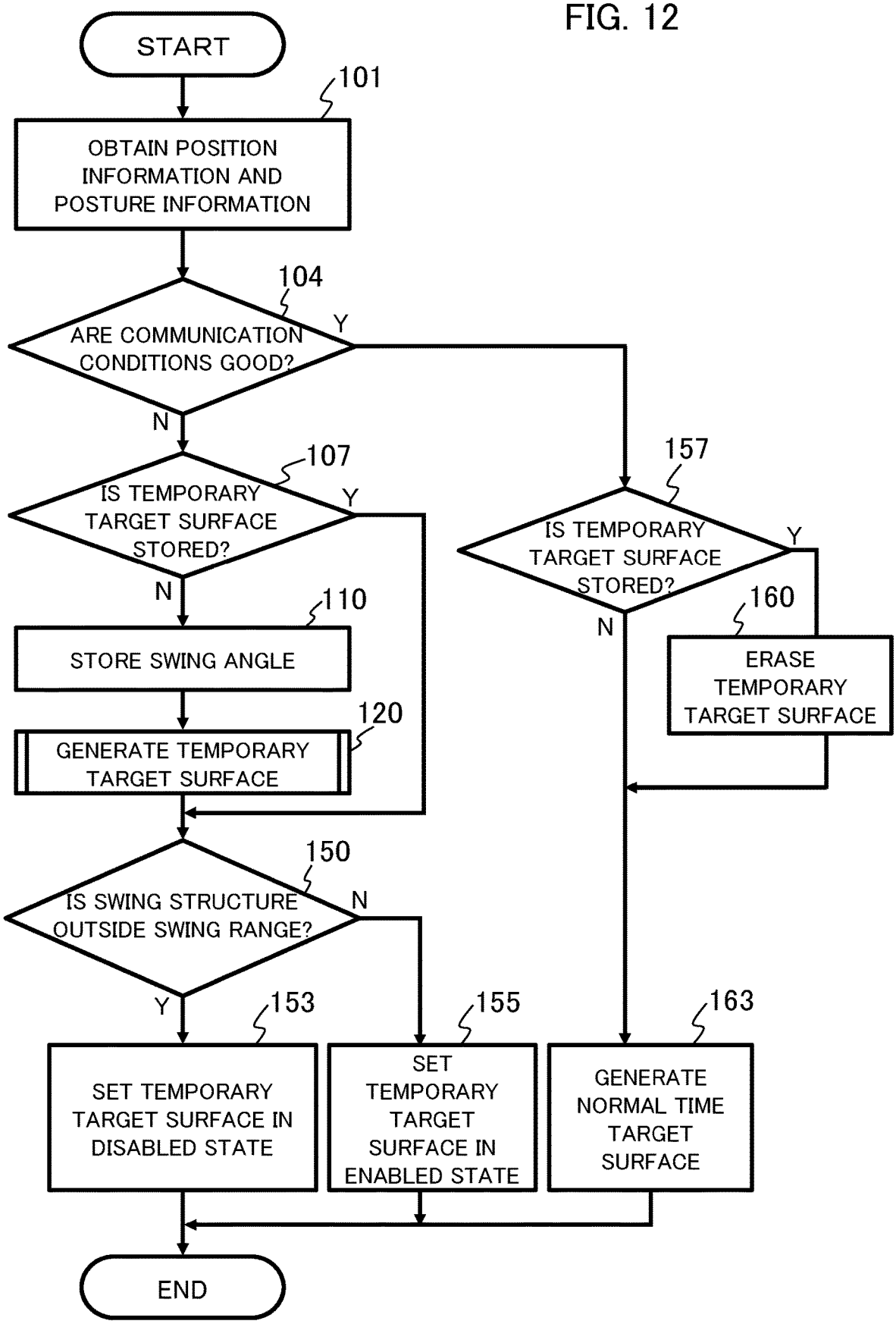
FIG. 12 is a flowchart showing contents of target surface setting processing performed by the controller.
Figure 13:
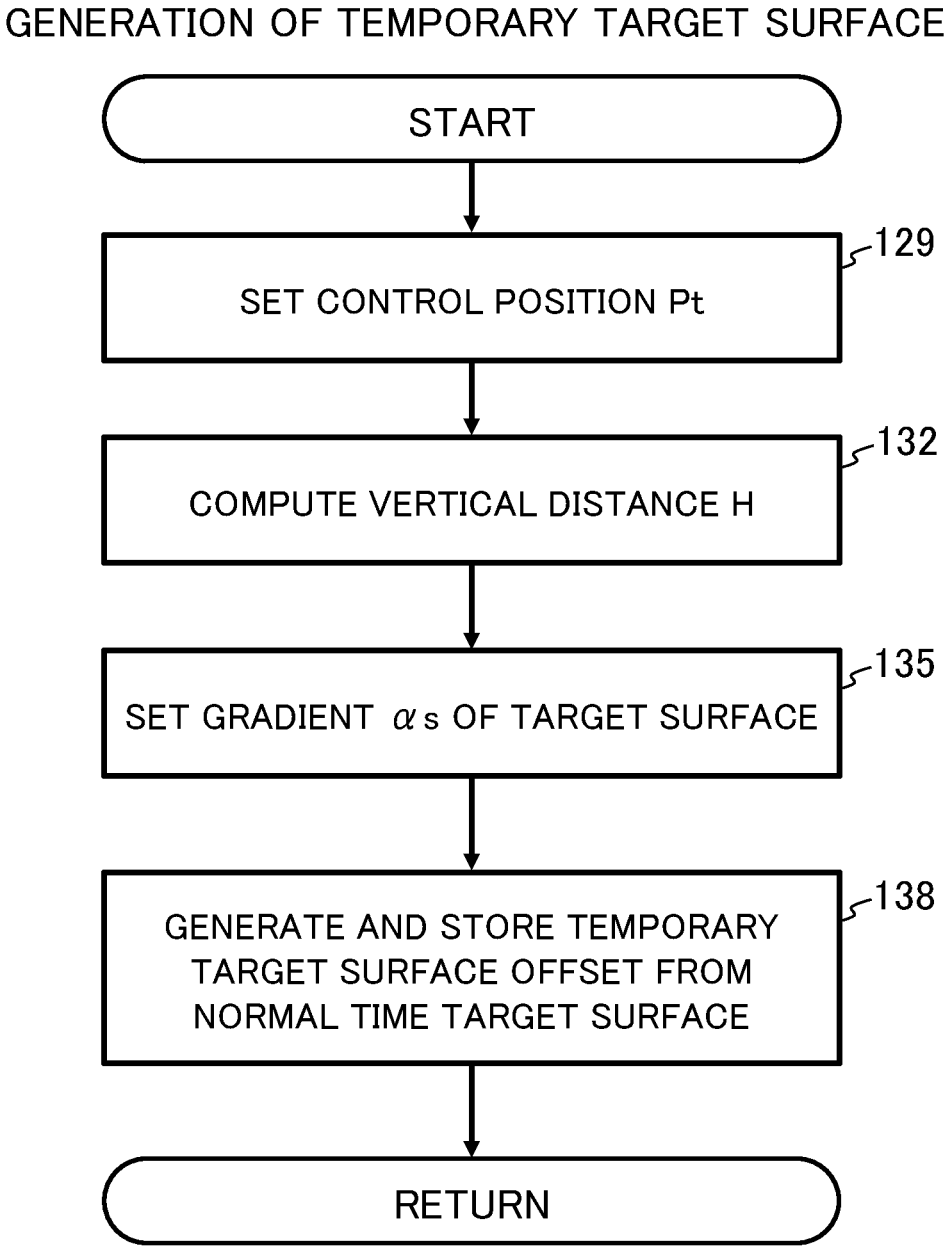
FIG. 13 is a flowchart showing contents of temporary target surface generation processing (step S120) in FIG. 12.

Referring to FIG. 12 and FIG. 13, description will be made of contents of target surface setting processing performed by the controller 20 functioning as the target surface setting section 37. FIG. 12 is a flowchart showing the contents of the target surface setting processing performed by the controller 20. FIG. 13 is a flowchart showing contents of temporary target surface generation processing (step S120) in FIG. 12. The processing of the flowchart shown in FIG. 12 is started by setting the machine control in an enabled state by using the MC switch 26, and is repeatedly performed in a predetermined control cycle after an initial setting not shown is made.

As shown in FIG. 12, in step S101, the target surface setting section 37 obtains position information from the position sensor 42 and posture information computed by the posture computing section 30. The processing then proceeds to step S104.

In step S104, the target surface setting section 37 determines whether or not the communication conditions of the GNSS antennas 42*a* and 42*b* are good on the basis of the position information from the position sensor 42. When the position information from the position sensor 42 which position information is obtained in step S101 is not the position sensing error signal, the target surface setting section 37 determines that the communication conditions of the GNSS antennas 42*a* and 42*b* are good. The processing then proceeds to step S157. When the position information from the position sensor 42 which position information is obtained in step S101 is the position sensing error signal, the target surface setting section 37 determines that the communication conditions of the GNSS antennas 42*a* and 42*b* are not good. The processing then proceeds to step S107.

In step S107, the target surface setting section 37 refers to the storage device, and determines whether or not the temporary target surface Stb is stored in a predetermined storage area. When it is determined in step S107 that the temporary target surface Stb is not stored in the predetermined storage area of the storage device, the processing proceeds to step S110. When it is determined in step S107 that the temporary target surface Stb is stored in the predetermined storage area of the storage device, the processing proceeds to step S150.

In step S110, the target surface setting section 37 stores the swing angle θ of the swing structure 12 which swing angle is included in the posture information obtained in step S101 as the reference swing angle θ0 in the storage device. The processing then proceeds to step S120.

In step S120, the target surface setting section 37 performs the temporary target surface generation processing. Processing of steps S129 to S138 shown in FIG. 13 is performed in the temporary target surface generation processing (step S120).

As shown in FIG. 13, in step S129, the target surface setting section 37 sets the control position Pt on the basis of the normal time target surface Sta computed in step S163 and stored in the storage device and the distal end position Pb of the bucket 10 which distal end position is included in the posture information obtained in step S101. The processing then proceeds to step S132.

In step S132, the target surface setting section 37 computes the distance H in the vertical direction from the distal end position Pb of the bucket 10 to the control position Pt on the basis of the control position Pt set in step S129 and the distal end position Pb of the bucket 10 which distal end position is included in the posture information obtained in step S101. The processing then proceeds to step S135.

In step S135, the target surface setting section 37 sets the gradient as of the target surface on the basis of the normal time target surface Sta computed in step S163 and stored in the storage device and the control position Pt set in step S120. The processing then proceeds to step S138. In step S138, the target surface setting section 37 computes the offset amount Hos on the basis of the vertical distance H. In addition, the target surface setting section 37 generates the temporary target surface Stb offset upward in the vertical direction from the normal time target surface Sta as a surface having the gradient as by the offset amount Hos. Further, the target surface setting section 37 stores the generated temporary target surface Stb in a predetermined storage area of the storage device. The target surface setting section 37 then ends the processing shown in the flowchart of FIG. 13.

As shown in FIG. 12, when the temporary target surface generation processing (step S120) is completed, the processing proceeds to step S150. In step S150, the target surface setting section 37 determines whether or not the swing structure 12 is positioned outside the swing range Sr on the basis of the swing angle θ of the swing structure 12 which swing angle is included in the posture information obtained in step S101 and the reference swing angle θ0 stored in step S110.

In step S150, the target surface setting section 37 computes the difference Δθ between the swing angle θ of the swing structure 12 and the reference swing angle θ0. In step S150, when the difference Δθ is equal to or less than the predetermined value Δθ0, the target surface setting section 37 determines that the swing structure 12 is positioned inside the swing range Sr. The processing then proceeds to step S155. In step S150, when the difference Δθ is larger than the predetermined value Δθ0, the target surface setting section 37 determines that the swing structure 12 is positioned outside the swing range Sr. The processing then proceeds to step S153.

In step S155, the target surface setting section 37 sets the temporary target surface Stb as the target surface St to be used in the machine control to enable the temporary target surface Stb. The target surface setting section 37 then ends the processing shown in the flowchart of FIG. 12. When the temporary target surface Stb is set as the target surface St, the execution of the machine control based on the temporary target surface Stb is permitted. Hence, the controller 20 successively computes the distance between the target surface St (temporary target surface Stb) and the distal end position Pb of the bucket 10 (target surface distance), and performs the machine control when the target surface distance is equal to or less than the predetermined distance Ya1.

In step S153, the target surface setting section 37 sets the invalid value as the target surface distance to disable the temporary target surface Stb. The target surface setting section 37 then ends the processing shown in the flowchart of FIG. 12. When the invalid value is set as the target surface distance, the execution of the machine control based on the temporary target surface Stb is prohibited. Hence, the machine control is not performed even when the distance between the distal end position Pb of the bucket 10 and the temporary target surface Stb is equal to or less than the predetermined distance Ya1.

In step S157, the target surface setting section 37 refers to the storage device, and determines whether or not the temporary target surface Stb is stored in a predetermined storage area. When it is determined in step S157 that the temporary target surface Stb is not stored in the predetermined storage area of the storage device, the processing proceeds to step S163. When it is determined in step S157 that the temporary target surface Stb is stored in the predetermined storage area of the storage device, the processing proceeds to step S160.

In step S160, the target surface setting section 37 erases the temporary target surface Stb stored in the predetermined storage area of the storage device. The processing then proceeds to step S163. In step S163, the target surface setting section 37 obtains three-dimensional target shape data from the target surface setting device 36, generates the normal time target surface Sta on the basis of the obtained target shape data and the posture information (information about the posture of the work device 1B in the global coordinate system) obtained in step S101, and stores the normal time target surface Sta in the storage device. In step S160, the target surface setting section 37 sets the generated normal time target surface Sta as the target surface St to be used in the machine control. The target surface setting section 37 then ends the processing shown in the flowchart of FIG. 12. When the normal time target surface Sta is set as the target surface St, the controller 20 successively computes the distance between the target surface St (normal time target surface Sta) and the distal end position Pb of the bucket 10 (target surface distance).

An example of operation in the present embodiment will be described. When the operator enables the machine control by operating the MC switch 26, the normal time target surface Sta is generated on the basis of the position and orientation of the swing structure 12 which position and orientation are computed on the basis of satellite signals received by the GNSS antennas 42*a* and 42*b* and the posture information sensed by the posture sensor 35 (S101 in FIG. 12→Y in S104→N in S157→S163). Therefore, the normal time target surface Sta is set as the target surface St to be used in the machine control.

Hence, as shown in FIG. 7, for example, when the operator performs an arm pulling operation and thereby makes the arm 9 perform a crowding operation, a boom raising operation is performed such that a velocity vector of the distal end portion of the bucket 10 in a direction perpendicular to the target surface St is zero. As a result, the distal end portion of the bucket 10 moves along the target surface St.

Here, when the communication conditions of the GNSS antennas 42*a* and 42*b* are degraded and the position information of the swing structure 12 becomes unable to be sensed during the execution of the machine control, the controller 20 stores the swing angle θ of the swing structure 12 at that time as the reference swing angle θ0, generates the temporary target surface Stb on the basis of the normal time target surface Sta, and stores the temporary target surface Stb in a predetermined storage area of the storage device (S101 in FIG. 12→N in S104→N in S107→S110→S120).

When the operator continues performing the arm pulling operation without swinging the swing structure 12, the controller 20 sets the temporary target surface Stb as the target surface St to be used in the machine control (N in S150 in FIG. 126→S155). Therefore, the operator can continue work using the machine control.

When an excavated object such as soil is accumulated within the bucket 10, the operator swings the swing structure 12, and loads the excavated object within the bucket 10 onto a transportation vehicle such as a dump truck. Thereafter, the swing structure 12 is swung in order to return the swing structure 12 to an original position. Here, when the swing structure 12 is positioned inside the swing range Sr set with the original position as a reference, the temporary target surface Stb is set as the target surface St to be used in the machine control (S101 in FIG. 12→N in S104→Y in S107→N in S150→S155). Hence, when the operator has swung the swing structure 12 to the original position after performing the loading work, the operator can move the bucket 10 along the target surface St by the machine control again, and thereby perform work such as ground leveling or excavation.

Incidentally, when the swing structure 12 is positioned outside the swing range Sr in a case where the swing structure 12 is swung to return the swing structure 12 to the original position after the loading work is performed, the temporary target surface Stb is set in a disabled state (Y in S150 in FIG. 12→S153). In addition, the notifying device 39 notifies the operator that the temporary target surface Stb is set in a disabled state. Therefore, the operator can be informed that a present state is a state in which the communication conditions are not good and that the swing structure 12 is positioned outside the swing range Sr.

When the operator swings the swing structure 12, and thereby the swing structure 12 moves into the swing range Sr, the notifying device 39 notifies the operator that the temporary target surface Stb is set in an enabled state. Therefore, the operator can easily swing the swing structure 12 to the original position, and perform work using the machine control.

The foregoing embodiment produces the following actions and effects.

(1) The hydraulic excavator (work machine) 1 includes: the track structure 11; the swing structure 12 swingably attached onto the track structure 11; the articulated work device 1B attached to the swing structure 12, and including the boom 8, the arm 9, and the bucket (work tool) 10; the position sensor 42 that senses the position information of the swing structure 12; the posture sensor 35 that senses information about the posture of the hydraulic excavator 1, the information including the swing angle θ of the swing structure 12; and the controller 20 configured to obtain the target shape data, set the target surface St on the basis of the obtained target shape data, the position information of the swing structure 12, and the information about the posture of the hydraulic excavator 1, and perform the machine control that controls the work device 1B on the basis of the target surface St. When the controller 20 becomes unable to obtain the position information of the swing structure 12 by the position sensor 42 during the execution of the machine control, the controller 20 stores, as the reference swing angle information (reference swing angle θ0), the swing angle information (swing angle θ) of the swing structure 12, the swing angle information being sensed by the posture sensor 35 when the controller 20 becomes unable to obtain the position information of the swing structure 12 by the position sensor 42. The controller 20 prohibits the execution of the machine control based on the target surface St when the swing structure 12 is positioned outside the swing range Sr set on the basis of the reference swing angle information (reference swing angle θ0). The controller 20 permits the execution of the machine control based on the target surface St when the swing structure 12 is positioned inside the swing range Sr. That is, when the controller 20 becomes unable to obtain the position information of the swing structure 12 by the position sensor 42, and the swing structure 12 is positioned outside the swing range Sr, the controller 20 prohibits the execution of the machine control based on the target surface St, and when the swing structure 12 is positioned inside the swing range Sr again after being positioned outside the swing range Sr, the controller 20 permits the execution of the machine control based on the target surface St.

According to this configuration, in a case where the position information of the swing structure 12 becomes unable to be obtained by the position sensor 42 due to a degradation in the communication conditions or the like during the execution of the machine control, even when the swing structure 12 is swung and the work of loading the excavated object onto the transportation vehicle is performed, work using the machine control based on the target surface St is enabled again by swinging the swing structure 12 into the swing range Sr. Hence, according to the present embodiment, it is possible to provide the hydraulic excavator 1 that can suppress a decrease in work efficiency.

(2) The controller 20 generates the temporary target surface Stb based on the gradient as of the target surface St (normal time target surface Sta) as a new target surface when the controller 20 becomes unable to obtain the position information of the swing structure 12 by the position sensor 42 during the execution of the machine control. The controller 20 permits the execution of the machine control based on the temporary target surface Stb when the swing structure 12 is positioned inside the swing range Sr.

According to this configuration, the temporary target surface Stb is newly generated separately from the target surface (normal time target surface Sta) set before the position information of the swing structure 12 becomes unable to be obtained by the position sensor 42. Thus, the target surface St can be adjusted by, for example, setting the temporary target surface Stb at a position different from that of the normal time target surface Sta (for example, an offset position) or changing the gradient of the temporary target surface Stb.

(3) The controller 20 generates the temporary target surface Stb offset from the target surface St (normal time target surface Sta) by a predetermined distance (offset amount Hos) on the basis of the gradient as of the target surface St (normal time target surface Sta).

According to this configuration, when the swing structure 12 is positioned inside the swing range Sr and the swing structure 12 is positioned so as to be shifted from the reference swing angle θ0 while the machine control based on the temporary target surface Stb is performed, the bucket 10 can be prevented from entering the lower side of the target surface St and excavating an excavation target object too much. When the temporary target surface Stb is offset from the normal time target surface Sta, a wider swing range Sr can be adopted as compared with a case where the temporary target surface Stb is not offset from the normal time target surface Sta.

(4) The controller 20 erases the temporary target surface Stb and generates the target surface St (normal time target surface Sta) on the basis of the target shape data, the position information of the swing structure 12, and the information about the posture of the hydraulic excavator 1 when the controller 20 becomes able to obtain the position information of the swing structure 12 by the position sensor 42.

According to this configuration, when the communication conditions are restored, the normal target surface St (normal time target surface Sta) is generated. Hence, when the swing structure 12 is swung to the outside of the swing range Sr, for example, the normal target surface St (normal time target surface Sta) is newly generated on the basis of the posture of the hydraulic excavator 1 at that time. It is therefore possible to make a transition to work such as excavation or ground leveling at another place.

(5) The hydraulic excavator 1 further includes the notifying device 39 that makes a notification to the operator. The controller 20 notifies the notifying device 39 whether the swing structure 12 is positioned outside the swing range Sr or is positioned inside the swing range Sr when the controller 20 becomes unable to obtain the position information of the swing structure 12 by the position sensor 42 during the execution of the machine control. The notifying device 39 makes a notification to the operator on the basis of a notification command from the controller 20.

According to this configuration, the operator can easily check whether or not work using the machine control can be performed in a state in which the communication conditions are not good. Therefore, after the swing structure 12 is swung and loading work is performed, the swing structure 12 can be easily and quickly swung to a position (original position) at which the work using the machine control can be performed. As a result, work efficiency can be improved. In addition, it is possible to call the attention of the operator so that the operator does not perform an excavating operation when the swing structure 12 is positioned outside the swing range Sr in a state in which the communication conditions are not good.

The following modifications are also within the scope of the present invention. It is possible to combine a configuration illustrated in a modification and a configuration described in the foregoing embodiment with each other, or combine configurations described in the following different modifications with each other.

<First Modification>

In the foregoing embodiment, description has been made of an example in which when the communication conditions change from a state of being good to a state of not being good, the temporary target surface Stb is newly generated as another target surface than the normal time target surface Sta, and the temporary target surface Stb is set as the target surface St to be used in the machine control. However, the present invention is not limited to this. When the communication conditions change from a state of being good to a state of not being good, the controller 20 may retain the currently set target surface St (normal time target surface Sta), and perform the machine control on the basis of the target surface St (normal time target surface Sta) when the swing structure 12 is positioned inside the swing range Sr.

That is, when the controller 20 becomes unable to obtain the position information of the swing structure 12 by the position sensor 42, and the swing structure 12 is positioned outside the swing range Sr, the controller 20 may prohibit the execution of the machine control based on the retained normal time target surface Sta, and when the swing structure 12 is positioned inside the swing range Sr, the controller 20 may permit the execution of the machine control based on the retained normal time target surface Sta.

<Second Modification>

Figure 14:
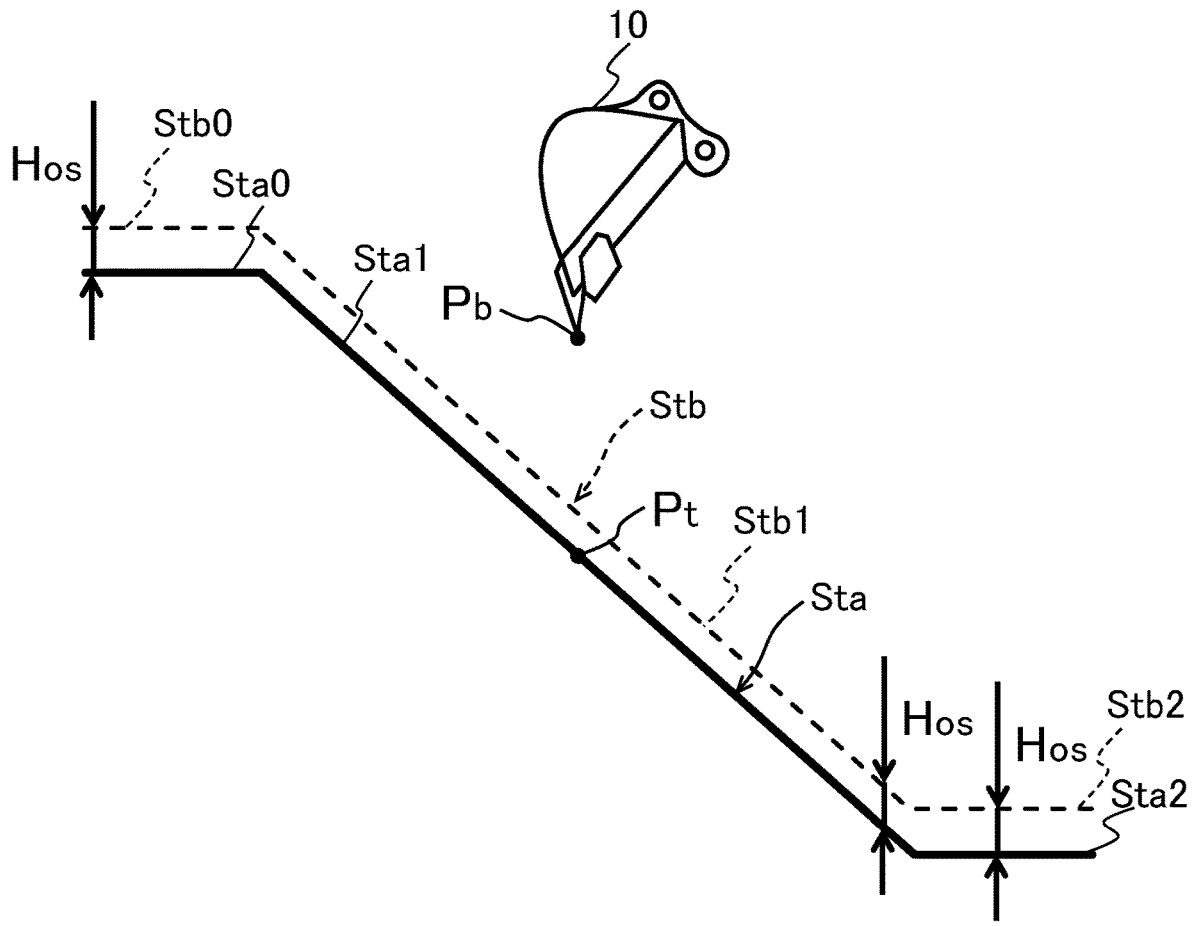
FIG. 14 is a diagram of assistance in explaining contents of processing of generating a temporary target surface by a controller according to a modification of the present embodiment.

In the foregoing embodiment, description has been made of an example in which a point of intersection of a straight line drawn downward in the vertical direction from the distal end position Pb of the bucket 10 and the normal time target surface Sta is set as the control position Pt, and the temporary target surface Stb offset from the target surface element Sta1 is generated on the basis of the target surface element Sta1 including the control position Pt. However, the present invention is not limited to this. As shown in FIG. 14, the temporary target surface Stb may be generated by offsetting each of the plurality of target surface elements Sta0, Sta1, and Sta2, and connecting the plurality of offset surfaces (lines) to each other at points of intersection of the plurality of offset surfaces (lines).

<Third Modification>

In the foregoing embodiment, description has been made of an example in which the controller 20 sets the offset amount Hos on the basis of the vertical distance H. However, the present invention is not limited to this. The controller 20 may generate the temporary target surface Stb by using an offset amount (constant) stored in the ROM 20*b* in advance.

<Fourth Modification>

In the foregoing embodiment, description has been made of an example in which the notifying device 39 is a display device. However, the present invention is not limited to this. It is possible to adopt, as the notifying device 39, a sound output device, a light emitting device, a vibrating device, or the like that can notify the operator by sound, light, or vibration whether the swing structure 12 is positioned outside the swing range Sr or is positioned inside the swing range Sr.

<Fifth Modification>

The controller 20 may have the functions of the positioning computing device 42*c* of the position sensor 42.

<Sixth Modification>

In the foregoing embodiment, description has been made by taking as an example a case where the work machine is a crawler type hydraulic excavator 1. However, the present invention is not limited to this. The present invention can be applied to various work machines including a swing structure swingably attached onto a track structure and a work device attached to the swing structure, the various work machines including a wheeled hydraulic excavator and the like.

<Seventh Modification>

In the foregoing embodiment, description has been made of an example in which the operation devices 15A to 15D are hydraulic pilot type operation devices. However, the present invention is not limited to this. Electric operation devices may be arranged, and the flow control valves 16*a* to 16*d* may be driven by control of the solenoid proportional valves by the controller on the basis of electric signals from the operation devices.

<Eighth Modification>

In the foregoing embodiment, description has been made of an example in which the actuators that drive the boom 8, the arm 9, and the bucket 10 are hydraulic cylinders. However, the present invention is not limited to this. The actuators that drive the boom 8, the arm 9, and the bucket 10 may be electric cylinders.

<Ninth Modification>

A part or the whole of the functions of the controller 20 described in the foregoing embodiment may be implemented by hardware (for example, by designing logic for performing each function by an integrated circuit).

An embodiment of the present invention has been described above. However, the foregoing embodiment merely represents a part of examples of application of the present invention, and is not intended to limit the technical scope of the present invention to concrete configurations of the foregoing embodiment.

DESCRIPTION OF REFERENCE CHARACTERS

1: Hydraulic excavator (work machine)
1B: Work device
8: Boom
9: Arm
10: Bucket (work tool)
11: Track structure
12: Swing structure
20: Controller
21 to 24: Angle sensor (posture sensor)
35: Posture sensor
36: Target surface setting device
39: Notifying device
42: Position sensor
42*a*, 42*b*: GNSS antenna
42*c*: Positioning computing device
60: Hydraulic control unit
100: Hydraulic drive system
H: Vertical distance
Hos: Offset amount
Pb: Distal end position
Pt: Control position
Sr: Swing range
St: Target surface
Sta: Normal time target surface
Stb: Temporary target surface
Ya1: Distance
α: Boom angle
αs: Gradient
β: Arm angle
γ: Bucket angle
θ: Swing angle
θ0: Reference swing angle

The invention claimed is:

1. A work machine comprising: a track structure; a swing structure swingably attached onto the track structure; a work device attached to the swing structure; a position sensor that senses position information of the swing structure; a posture sensor that senses posture information of the work machine, the posture information including a swing angle of the swing structure; and a controller configured to:

obtain target shape data, set a target surface on a basis of the obtained target shape data, the position information of the swing structure, and the posture information of the work machine, and perform machine control that controls the work device on a basis of the target surface, the controller being further configured to:

upon the controller becoming unable to obtain the position information of the swing structure by the position sensor, store, as reference swing angle information, swing angle information, prohibit execution of the machine control based on the target surface when the swing structure is positioned outside a swing range set on a basis of the reference swing angle information, and permit the execution of the machine control based on the target surface when the swing structure is positioned inside the swing range and when the swing structure is positioned inside the swing range again after being positioned outside the swing range.

2. The work machine according to claim 1, wherein the controller is further configured to:

generate, as a new target surface, a temporary target surface based on a gradient of the target surface when the controller becomes unable to obtain the position information of the swing structure by the position sensor, and permit the execution of the machine control based on the temporary target surface when the swing structure is positioned inside the swing range.

3. The work machine according to claim 2, wherein the controller is further configured to generate the temporary target surface offset from the target surface by a predetermined distance on a basis of the gradient of the target surface.

4. The work machine according to claim 2, wherein the controller is further configured to erase the temporary target surface and generate the target surface on a basis of the target shape data, the position information of the swing structure, and the posture information of the work machine when the controller becomes able to obtain the position information of the swing structure by the position sensor.

5. The work machine according to claim 1, further comprising a notifying device that makes a notification to an operator, wherein the controller is further configured to notify the notifying device whether the swing structure is positioned outside the swing range or is positioned inside the swing range, when the controller becomes unable to obtain the position information of the swing structure by the position sensor.

6. The work machine according to claim 1, wherein the swing angle information includes the swing angle, the reference swing angle information includes a reference swing angle that is the swing angle when the controller becomes unable to obtain the position information of the swing structure by the position sensor, and the controller is further configured to:

prohibit the execution of the machine control based on the target surface when a difference between the swing angle sensed by the posture sensor and the reference swing angle is larger than a predetermined value, and permit the execution of the machine control based on the target surface when the difference between the swing angle sensed by the posture sensor and the reference swing angle is equal to or less than the predetermined value.

* * * * *